US007964327B2

(12) United States Patent
Gondoh et al.

(10) Patent No.: US 7,964,327 B2
(45) Date of Patent: Jun. 21, 2011

(54) ELECTROPHOTOGRAPHIC PHOTORECEPTOR AND METHOD OF PREPARING THE PHOTORECEPTOR, AND IMAGE FORMING APPARATUS, IMAGE FORMING METHOD AND PROCESS CARTRIDGE USING THE PHOTORECEPTOR

(75) Inventors: Masanobu Gondoh, Ebina (JP); Akihiro Sugino, Numazu (JP); Hideo Nakamori, Numazu (JP); Shinji Nohsho, Numazu (JP); Tomoyuki Shimada, Shizuoka-ken (JP); Takaaki Ikegami, Susono (JP)

(73) Assignee: Ricoh Company Ltd., Tokyo (JP)

( * ) Notice: Subject to any disclaimer, the term of this patent is extended or adjusted under 35 U.S.C. 154(b) by 983 days.

(21) Appl. No.: 11/762,296

(22) Filed: Jun. 13, 2007

(65) Prior Publication Data

US 2007/0287083 A1 Dec. 13, 2007

(30) Foreign Application Priority Data

Jun. 13, 2006 (JP) ..... 2006-162994
Mar. 12, 2007 (JP) ..... 2007-061205
Apr. 26, 2007 (JP) ..... 2007-116422

(51) Int. Cl.
*G03G 5/047* (2006.01)

(52) U.S. Cl. ..... 430/58.85; 430/58.75; 430/123.42; 399/159

(58) Field of Classification Search ..... 430/58.05, 430/58.75, 58.85, 123.42; 399/159, 111
See application file for complete search history.

(56) References Cited

U.S. PATENT DOCUMENTS 4,957,839 A 9/1990 Rokutanzono et al.
5,008,172 A 4/1991 Rokutanzono et al.
5,147,751 A 9/1992 Kojima et al.
5,342,718 A 8/1994 Nousho et al.
5,409,792 A * 4/1995 Yanus et al. ..... 430/58.6
5,413,886 A * 5/1995 Pai et al. ..... 430/58.65
5,991,573 A 11/1999 Nohsho et al.
6,618,565 B2 9/2003 Tamiya et al.
6,741,821 B2 5/2004 Sugino et al.
6,777,149 B2 8/2004 Ikegami et al.
6,777,150 B2 8/2004 Suzuki et al.
6,785,500 B2 8/2004 Takahashi et al.
6,816,691 B2 11/2004 Kabata et al.
6,829,450 B2 12/2004 Tamiya et al.
6,830,858 B2 12/2004 Sugino et al.
6,853,823 B2 2/2005 Sugino et al.
6,853,834 B2 2/2005 Kurimoto et al.
6,879,799 B2 4/2005 Nohsho et al.
7,005,006 B2 2/2006 Suzuki et al.
7,010,247 B2 3/2006 Suzuki et al.
7,027,759 B2 4/2006 Kabata et al.
7,031,650 B2 4/2006 Kurimoto et al.
7,177,583 B2 2/2007 Kurimoto et al.
7,212,777 B2 5/2007 Takada et al.
2002/0106570 A1* 8/2002 Kami et al. ..... 430/58.05
2003/0002078 A1 1/2003 Toda et al.
2005/0008957 A1* 1/2005 Ikegami et al. ..... 430/58.7
2005/0026058 A1 2/2005 Kami et al.
2005/0053853 A1 3/2005 Sugino et al.
2005/0118518 A1 6/2005 Ikegami et al.
2005/0130050 A1 6/2005 Takada et al.
2006/0127116 A1 6/2006 Ogiyama et al.
2006/0141378 A1 6/2006 Takada et al.
2006/0199092 A1 9/2006 Sugino et al.
2006/0269323 A1 11/2006 Kabata et al.
2007/0015074 A1 1/2007 Sugino et al.
2007/0019989 A1 1/2007 Nakamori
2007/0059618 A1 3/2007 Kurimoto et al.

FOREIGN PATENT DOCUMENTS

JP 03050554 A * 3/1991
JP 03259266 A * 11/1991
JP 10090924 A * 4/1998
JP 10213915 A * 8/1998
JP 2003-316063 11/2003
JP 2004-102199 4/2004
JP 2004-233955 8/2004
JP 2004-258253 9/2004
JP 2004-258408 9/2004
JP 2004-264788 9/2004
JP 2005-003910 1/2005
JP 2005-003924 1/2005
JP 2005-024983 1/2005
JP 2005-099211 4/2005
JP 2006-079006 3/2006

OTHER PUBLICATIONS

Diamond, Arthur S & David Weiss (eds.) Handbook of Imaging Materials, 2nd ed.. New York: Marcel-Dekker, Inc. (Nov. 2001) pp. 145-168.*
Enhlish language machine translation of JP 10-090924 (Apr. 1998).*
English language machine translation of JP 10-213915 (Aug. 1998).*
U.S. Appl. No. 12/030,886, filed Feb. 14, 2008, Toda, et al.
U.S. Appl. No. 12/043,407, filed Mar. 6, 2008, Nakamori, et al.
U.S. Appl. No. 11/224,984, filed Sep. 14, 2005, Nousho et al.

* cited by examiner

*Primary Examiner* — Christopher RoDee
(74) *Attorney, Agent, or Firm* — Oblon, Spivak, McClelland, Maier & Neustadt, L.L.P.

(57) ABSTRACT

An electrophotographic photoreceptor, including an electroconductive substrate; and a photosensitive layer, located overlying the electroconductive substrate, wherein an outermost layer of the electrophotographic photoreceptor includes an amine compound and a charge transport material, and wherein the amine compound includes an amine site having an electrostatic potential with a dimensionless unit not greater than −0.27.

19 Claims, 13 Drawing Sheets

ELECTROPHOTOGRAPHIC PHOTORECEPTOR AND METHOD OF PREPARING THE PHOTORECEPTOR, AND IMAGE FORMING APPARATUS, IMAGE FORMING METHOD AND PROCESS CARTRIDGE USING THE PHOTORECEPTOR

CROSS-REFERENCE TO RELATED APPLICATIONS

This application claims priority and contains subject matter related to Japanese Patent Application Nos. 2006-162664, 2007-061205 and 2007-116422, filed on Jun. 13, 2006, Mar. 12, 2007 and Apr. 26, 2007 respectively, the entire contents of each of which are hereby incorporated by reference.

BACKGROUND OF THE INVENTION

1. Field of the Invention

The present invention relates to an electrophotographic photoreceptor, and to a method of preparing the photoreceptor, and an image forming apparatus, an image forming method and a process cartridge using the photoreceptor.

2. Discussion of the Background

Recently, information-processing systems using an electrophotographic method are making remarkable progress. In particular, laser printers and digital copiers which record data with light by changing the data into digital signals make remarkable improvements in their printing qualities and reliabilities. Further, technologies used in these printers and copiers are applied to laser printers and digital copiers capable of printing full-color images with high-speed printing technologies. Because of these reasons, photoreceptors are required to produce high-quality images while maintaining high durability.

Photoreceptors using organic photosensitive materials are widely used for laser printers and digital copiers due to their cost, productivity and non-polluting properties. As the organic electrophotographic photoreceptors, the photoreceptors including photoconductive resin typified by poly-N-vinylcarbazole(PVK); charge transfer complex type photoreceptors typified by PVK-TNF(2,4,7-trinitrofluorenon); pigment dispersion type photoreceptors typified by phthalocyanine-binder; and functionally-separated photoreceptors typified by combinations of a charge generation material (CGM) with a charge transport material (CTM) are known.

Among these various photoreceptors, the photoreceptors using organic photosensitive materials are mostly used as functionally-separated photoreceptors because of having good sensitivity and durability, wherein the charge generation materials and charge transport materials can individually be designed at a molecular level.

However, the organic photoreceptor having a photosensitive layer mainly formed of a low-molecular-weight CTM and an inactive polymer is typically soft and has a disadvantage of being easily abraded due to mechanical stress of a developing system and a cleaning system when repeatedly used in the electrophotographic process. When abraded, the potential and photosensitivity of the photoreceptor tend to deteriorate, resulting in background fouling due to a scratch on the surface thereof and deterioration of density and quality of the resultant images. Therefore, abrasion resistance of the organic photoreceptor has been an important subject. Further, recently, in accordance with speeding up of the printing speed and downsizing of an image forming apparatus, the photoreceptor has to have a smaller diameter, and durability becomes increasingly important.

A conventional mechanism to form an electrostatic latent image in the multi-layered photoreceptor is as follows:

the photoreceptor is charged and irradiated with light;

the light passes through the charge transport layer (CTL) and is absorbed by the CGM in the charge generation layer (CGL) to generate a charge;

the charge is injected into the CTL at an interface of the CGL and the CTL;

and the charge moves in the CTL by an electric field and neutralizes the charge on the surface of the photoreceptor to form an electrostatic latent image.

To improve the abrasion resistance of the photoreceptor, methods of imparting lubricity to the photosensitive layer, hardening the photosensitive layer, including a filler therein and using a high-molecular-weight CTM instead of a low-molecular-weight CTM are widely known. However, another problem occurs when these methods are used to prevent the abrasion of the photoreceptor. Namely, an oxidized gas such as ozone and NOx arising due to use conditions or environment, adheres to the surface of the photosensitive layer and decreases the surface resistance thereof, resulting in a problem such as blurring of the resultant images. So far, such a problem has been avoided to some extent because the material causing the blurred images are gradually scraped off in accordance with the abrasion of the photosensitive layer. However, in order to comply with the above-mentioned recent demand for higher sensitivity and durability of the photoreceptor, a new technique has to be imparted thereto. In order to decrease an influence of the material causing the blurred images, there is a method of equipping the photoreceptor with a heater, which is a large drawback for downsizing the apparatus and decreasing the electric power consumption. In addition, a method of including an additive such as an antioxidant in the photosensitive layer is effective, but since a simple additive does not have photoconductivity, including a large amount thereof in the photosensitive layer causes problems such as deterioration of the sensitivity and increase of residual potential of the resultant photoreceptor.

As mentioned above, the electrophotographic photoreceptor having less abrasion by being imparted with abrasion resistance or a process design around thereof inevitably produces blurred and low-resolution images, and it is difficult to have both high durability and high quality of the resultant images. This is because high surface resistance of the photosensitive layer is preferable for preventing blurred images and low surface resistance thereof is preferable for preventing an increase of residual potential.

Japanese Published Unexamined Patent Application No. 2000-231204 discloses a method of including at least a compound having a dialkylamino group in a photosensitive layer to solve the above-mentioned problem such as blurring of the resultant images due to a blur generating material such as an oxidizing gas. However, the compound has an effect on image quality after repeated use, but the resultant photoreceptor does not have high sensitivity and cannot comply with high speed printing because of having low charge transportability. Therefore, an additional amount thereof has a limit, and a method of combining the compound with a CTM to increase sensitivity and repeated use stability of the resultant photoreceptor is disclosed therein.

On the other hand, it is described that a stilbene compound having a dialkylamino group disclosed in Japanese Published Unexamined Patent Application No. 60-196768 and Japanese Patent No. 2884353 has an effect on the blurred images due to the oxidizing gas on page 37 of Konica Technical Report Vol. 13 written by Itami, et al. and published in 2000. However, since the compound has a substituted dialkylamino group having a strong mesomeric effect (+M effect) at a resonance portion in its triarylamine structure, which is a charge transport site, total ionization potential is extremely small.

Therefore, the compound has a critical defect of being quite difficult to use practically because charge retainability of a photosensitive layer in which the compound is used alone as a CTM largely deteriorates from the beginning or after repeated use. In addition, even when the above-mentioned stilbene compound is used together with other CTMs as it is in the present invention, the compound has a considerably smaller ionization potential than the other CTMs and becomes a trap site against a charge transport, and therefore, the resultant photoreceptor has quite a low sensitivity and a large residual potential.

Japanese Published Unexamined Patent Application No. 2004-258408 discloses a method of reducing hole trap sites to decrease a residual potential, wherein a compound having an alkylamino group has an oxidation potential not less than that of a CTM by a specific level. However, when the surface of a photoreceptor having higher durability is not refreshed or a oxidizing material such as NOx, having a very high concentration, is present, the method does not satisfy all the requirements such as abrasion resistance, and prevention of blurred images and residual potential.

Because of these reasons, a need exists for an electrophotographic photoreceptor producing images without the deterioration of image quality such as blurred images and increases of residual potential even after repeatedly used for long periods or in an environment including large amounts of an oxidizing gas.

SUMMARY OF THE INVENTION

Accordingly, an object of the present invention is to provide an electrophotographic photoreceptor producing images without deterioration in image quality such as blurred images and increased residual potential after being used repeatedly for long periods of time or in an environment including large amounts of an oxidizing gas.

Another object of the present invention is to provide an image forming apparatus, an image forming method and a process cartridge using the photoreceptor, in which the photoreceptor need not be exchanged, downsizable in accordance with the high-speed printing or smaller diameter of the photoreceptor, and having high durability, stability, and capable of producing high-quality images.

These objects and other objects of the present invention, either individually or collectively, have been satisfied by the invention of an electrophotographic photoreceptor, comprising:

an electroconductive substrate; and a photosensitive layer, located overlying the electroconductive substrate, wherein an outermost layer of the electrophotographic photoreceptor comprises an amine compound and a charge transport material, and wherein the amine compound comprises an amine site having an electrostatic potential having a dimensionless unit not greater than −0.27.

The electrophotographic photoreceptor preferably satisfies the following relationship (I):

$$0.06 \leqq (V-(-0.27))X \leqq 0.2 \quad \text{(I)}$$

wherein V is the electrostatic potential having a dimensionless unit of the amine site in the amine compound; and X is a content (% by weight) of the amine compound.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE PREFERRED EMBODIMENTS

Figure 1:
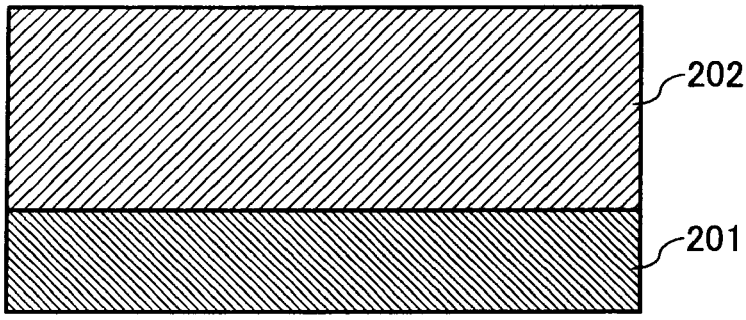
FIG. 1 is a cross-sectional view illustrating an embodiment of the photosensitive layer of the electrophotographic photoreceptor of the present invention.

The present invention provides an electrophotographic photoreceptor producing images without deterioration of image quality such as blurred images and increased residual potential after repeated use for long periods or in an environment including a large amount of an oxidizing gas, including:

an electroconductive substrate; and a photosensitive layer, located overlying the electroconductive substrate, wherein an outermost layer of the electrophotographic photoreceptor comprises an amine compound and a charge transport material, and wherein the amine compound comprises an amine site having an electrostatic potential having a dimensionless unit not greater than −0.27.

The electrostatic potential is a potential energy (having a dimensionless unit) felt by a +1 charge when located around a molecule, and protonated energy, i.e., a strength of basicity can be estimated depending on the size of the negative region.

A compound having an amine site, the electrostatic potential value of which is large in the negative region, i.e., having high basicity, included in an outermost layer of the photosensitive layer of an electrophotographic photoreceptor preferentially neutralizes an oxidizer to prevent blurred images.

In an embodiment of the present invention, the electrostatic potential of the amine site is measured by semiempirical molecular orbital calculation method (MOPAC2000) using a computational chemistry software CAChe Ver. 5.0 Worksystem from Fujitsu Limited. The calculation configuration dialog is Property: Electrostatic Potential on electron density, Using: MM/PM5 geometry with PM5 wavefunction.

When the content of the amine compound is too small, the creation of blurred images cannot be prevented well enough. When the content thereof is too large, the residual potential increases. Therefore, the electrostatic potential V of the amine site of the amine compound and the content X thereof preferably satisfy the following relationship (I):

$$0.06 \leqq -(V-(-0.27))X \leqq 0.2 \quad \text{(I).}$$

Specific examples of the amine compound for use in an embodiment of the present invention include compounds having the following formulae:

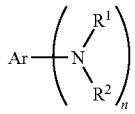

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; n represents an integer from 1 to 4; and Ar represents a substituted or unsubstituted aromatic ring group;

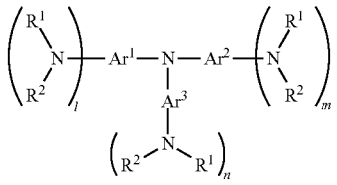

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a hetero cyclic group including a nitrogen atom; l, m and n independently represent 0 or an integer of from 1 to 3, and are not 0 at the same time; $Ar^1$, $Ar^2$ and $Ar^3$ independently represent a substituted or unsubstituted aromatic ring group; and $Ar^1$ and $Ar^2$, $Ar^2$ and $Ar^3$ or $Ar^3$ and $Ar^1$ may form a heterocyclic group including a nitrogen atom together;

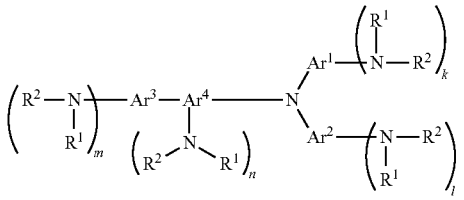

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; k, l, m and n independently represent 0 or an integer from 1 to 3, and are not 0 at the same time; $Ar^1$, $Ar^2$, $Ar^3$ and $Ar^4$ independently represent a substituted or unsubstituted aromatic ring group; and $Ar^1$ and $Ar^2$, $Ar^1$ and $Ar^4$ or $Ar^3$ and $Ar^4$ may form a ring together;

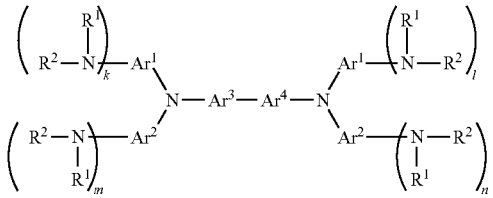

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; k, l, m and n independently represent 0 or an integer from 1 to 3, and are not 0 at the same time; $Ar^1$, $Ar^2$, $Ar^3$ and $Ar^4$ independently represent a substituted or unsubstituted aromatic ring group; and $Ar^1$ and $Ar^2$, $Ar^1$ and $Ar^3$ or $Ar^3$ and $Ar^4$ may form a ring together;

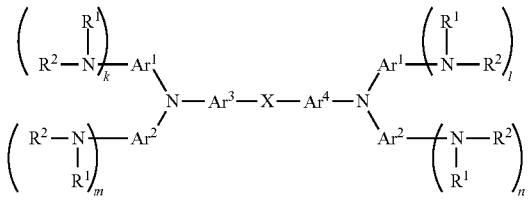

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; k, l, m and n independently represent 0 or an integer from 1 to 3, and are not 0 at the same time; $Ar^1$, $Ar^2$, $Ar^3$ and $Ar^4$ independently represent a substituted or unsubstituted aromatic ring group; $Ar^1$ and $Ar^2$, $Ar^1$ and $Ar^3$ or $Ar^1$ and $Ar^4$ may form a ring together; and X represents a methylene group, a cyclohexylidine group, an oxy atom or a sulfur atom;

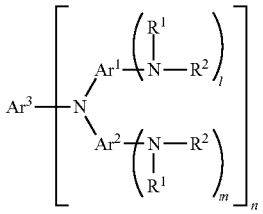

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; 1 and m independently represent 0 or an integer from 1 to 3, and are not 0 at the same time; $Ar^1$, $Ar^2$ and $Ar^3$ independently represent a substituted or unsubstituted aromatic ring group; $Ar^1$ and $Ar^2$ or $Ar^1$ and $Ar^3$ may form a ring together; and n represents an integer from 1 to 4;

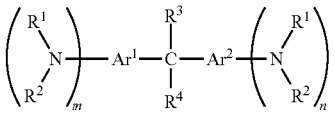

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; m and n independently represent 0 or an integer from 1 to 3, and are not 0 at the same time; $R^3$ and $R^4$ independently represent a hydrogen atom, a substituted or unsubstituted alkyl group having 1 to 11 carbon atoms and a substituted or unsubstituted aromatic ring group; and $Ar^1$ and $Ar^2$ independently represent a substituted or unsubstituted aromatic ring group, and one of $Ar^1$, $Ar^2$, $R^3$ and $R^4$ is an aromatic heterocyclic group;

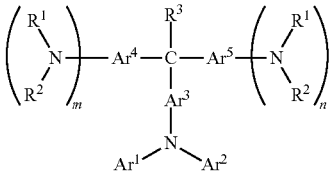

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; m and n independently represent 0 or an integer from 1 to 3, and are not 0 at the same time; $R^3$ represents a hydrogen atom, a substituted or unsubstituted alkyl group having 1 to 11 carbon atoms and a substituted or unsubstituted aromatic ring group; $Ar^1$, $Ar^2$, $Ar^3$, $Ar^4$ and $Ar^5$ independently represent a substituted or unsubstituted aromatic ring group; and $Ar^1$ and $Ar^2$ or $Ar^1$ and $Ar^3$ may form a heterocyclic group including a nitrogen atom together;

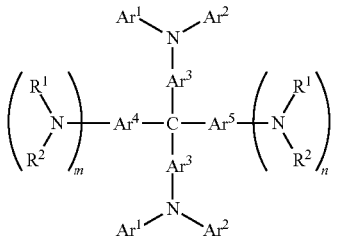

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; m and n independently represent 0 or an integer from 1 to 3, and are not 0 at the same time; $Ar^1$, $Ar^2$, $Ar^3$, $Ar^4$ and $Ar^5$ independently represent a substituted or unsubstituted aromatic ring group; and $Ar^1$ and $Ar^2$ or $Ar^1$ and $Ar^3$ may form a heterocyclic group including a nitrogen atom together;

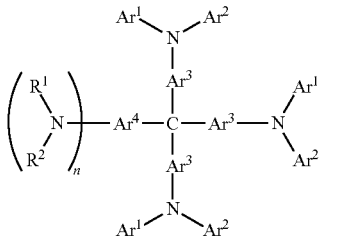

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; n represents an integer from 1 to 3; $Ar^1$, $Ar^2$, $Ar^3$ and $Ar^4$ independently represent a substituted or unsubstituted aromatic ring group; and $Ar^1$ and $Ar^2$ or $Ar^1$ and $Ar^3$ may form a heterocyclic group including a nitrogen atom together;

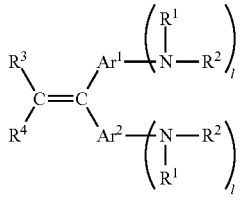

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; l represents an integer from 1 to 3; $Ar^1$ and $Ar^2$ independently represent a substituted or unsubstituted aromatic ring group; $R^3$ and $R^4$ independently represent a hydrogen atom, a substituted or unsubstituted alkyl group having 1 to 4 carbon atoms, a substituted or unsubstituted aromatic ring group or a group having the following formula:

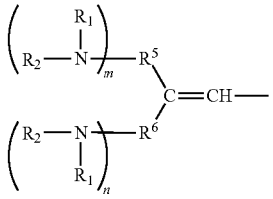

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; m and n independently represent 0 or an integer from 1 to 3; and $R^5$ and $R^6$ independently represent a hydrogen atom, a substituted or unsubstituted alkyl group having 1 to 4 carbon atoms or a substituted or unsubsituted aromatic ring group, and wherein $R^3$ and $R^4$, $R^5$ and $R^6$ or $Ar^1$ and $Ar^2$ may form a ring together;

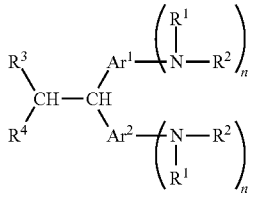

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; n represents an integer from 1 to 3; $Ar^1$ and $Ar^2$ independently represent a substituted or unsubstituted aromatic ring group; $R^3$ and $R^4$ independently represent a hydrogen atom, a substituted or unsubstituted alkyl group having 1 to 4 carbon atoms, a substituted or unsubstituted aromatic ring group or a group having the following formula, and $R^3$ and $R^4$ are not hydrogen atoms at the same time:

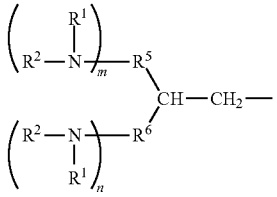

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; m and n independently represent 0 or an integer of from 1 to 3; and $R^5$ and $R^6$ independently represent a hydrogen atom, a substituted or unsubstituted alkyl group having 1 to 4 carbon atoms or a substituted or unsubstituted aromatic ring group, and wherein $R^3$ and $R^4$, $R^5$ and $R^6$ or $Ar^1$ and $Ar^2$ may form a ring together;

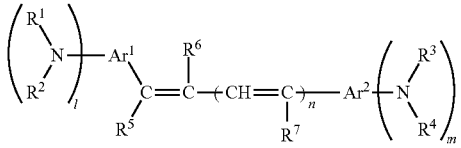

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; $R^3$ and $R^4$ independently represent a substituted or unsubstituted alkyl group having 1 to 4 carbon atoms or a substituted or unsubstituted aromatic ring group; $R^5$, $R^6$ and $R^7$ independently represent a hydrogen atom, a substituted or unsubstituted alkyl group having 1 to 4 carbon atoms or a substituted or unsubstituted aromatic ring group; $Ar^1$ and $Ar^2$ independently represent a substituted or unsubstituted aromatic ring group; $R^3$ and $R^4$ or $Ar^2$ and $R^4$ may form a heterocyclic group including a nitrogen atom together; $Ar^1$ and $R^5$ may form a ring together; l represents an integer of from 1 to 3; m represents 0 or an integer from 1 to 3; and n represents 0 or 1;

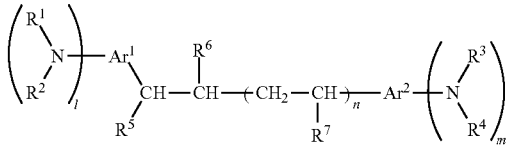

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; $R^3$ and $R^4$ independently represent a substituted or unsubstituted alkyl group having 1 to 4 carbon atoms or a substituted or unsubstituted aromatic ring group; $R^5$, $R^6$ and $R^7$ independently represent a hydrogen atom, a substituted or unsubstituted alkyl group having 1 to 4 carbon atoms or a substituted or unsubstituted aromatic ring group; $Ar^1$ and $Ar^2$ independently represent a substituted or unsubstituted aromatic ring group; $R^3$ and $R^4$ or $Ar^2$ and $R^4$ may form a heterocyclic group including a nitrogen atom together; $Ar^1$ and $R^5$ may form a ring together; l represents an integer of from 1 to 3; m represents 0 or an integer from 1 to 3; and n represents 0 or 1;

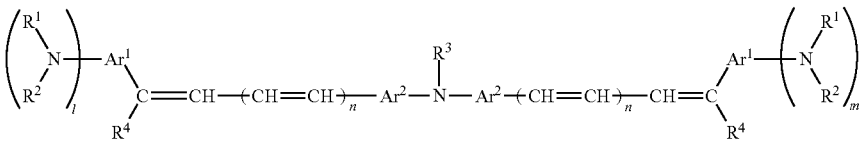

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; l and m independently represent 0 or an integer from 1 to 3, and are not 0 at the same time; $R^3$ represents a substituted or unsubstituted alkyl group having 1 to 4 carbon atoms or a substituted or unsubstituted aromatic ring group; $R^4$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $Ar^1$ and $R^4$, $Ar^2$ and $R^3$ or $Ar^2$ and another $Ar^2$ may form a ring together; and n represents 0 or 1;

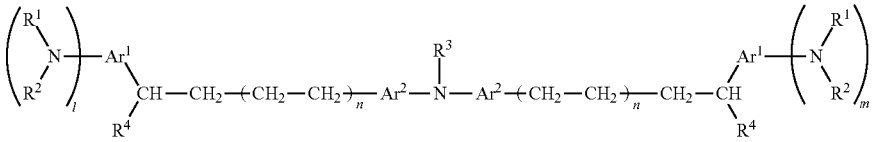

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; l and m independently represent 0 or an integer from 1 to 3, and are not 0 at the same time; $R^3$ represents a substituted or unsubstituted alkyl group having 1 to 4 carbon atoms or a substituted or unsubstituted aromatic ring group; $R^4$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $Ar^1$ and $R^4$, $Ar^2$ and $R^3$ or $Ar^2$ and another $Ar^2$ may form a ring together; and n represents 0 or 1;

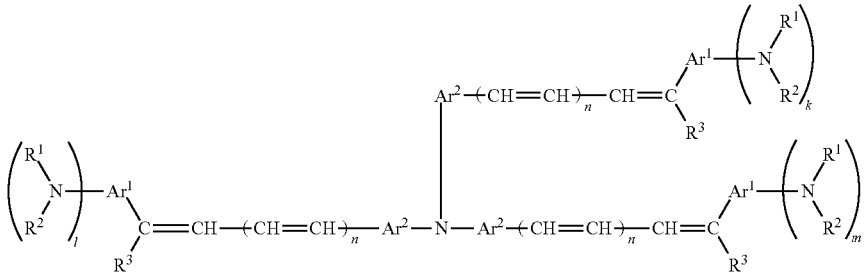

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; k, l and m independently represent 0 or an integer from 1 to 3, and are not 0 at the same time; $R^3$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $Ar^1$ and $R^4$, $Ar^2$ and $R^3$ or $Ar^2$ and another $Ar^2$ may form a ring together; and n represents 0 or 1;

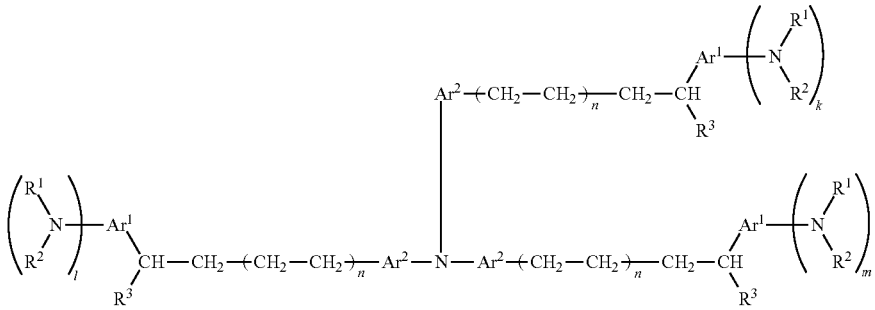

wherein $R^1$ and $R^2$independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; k, l and m independently represent 0 or an integer from 1 to 3, and are not 0 at the same time; $R^3$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $Ar^1$ and $R^4$, $Ar^2$ and $R^3$ or $Ar^2$ and another $Ar^2$ may form a ring together; and n represents 0 or 1;

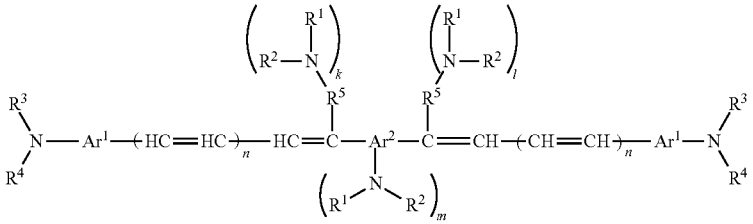

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; $R^3$ and $R^4$ independently represent a substituted or unsubstituted alkyl group having 1 to 4 carbon atoms or a substituted or unsubstituted aromatic ring group; $R^5$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $R^3$ and $R^4$ or $Ar^1$ and $R^4$ may form a heterocyclic group including a nitrogen atom together; k, l and m independently represent 0 or an integer from 1 to 3; n represents 1 or 2; and $R^3$ and $R^4$ independently represent an alkyl group having 1 to 4 carbon atoms and may be combined with each other to form a heterocyclic group including a nitrogen atom when k, 1 and m are 0 at the same time;

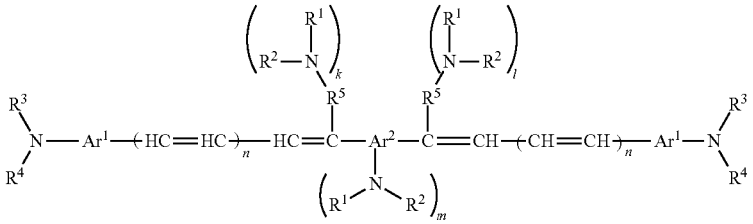

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; $R^3$ and $R^4$ independently represent a substituted or unsubstituted alkyl group having 1 to 4 carbon atoms or a substituted or unsubstituted aromatic ring group; $R^5$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $R^3$ and $R^4$ or $Ar^1$ and $R^4$ may form a heterocyclic group including a nitrogen atom together; k, l and m independently represent 0 or an integer from 1 to 3; n represents 1 or 2; and $R^3$ and $R^4$ independently represent an alkyl group having 1 to 4 carbon atoms and may be combined with each other to form a heterocyclic group including a nitrogen atom when k, l and m are 0 at the same time;

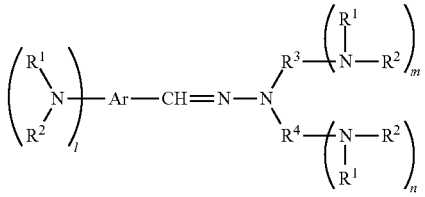

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; Ar represents a substituted or unsubstituted aromatic ring group; $R^3$ and $R^4$ represent a hydrogen atom, a substituted or unsubstituted alkyl group having 1 to 4 carbon atoms or a substituted or unsubstituted aromatic ring group; and l, m and n independently represent 0 or an integer from 1 to 3, and are not 0 at the same time;

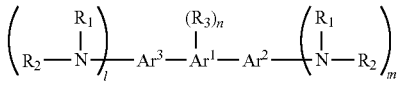

wherein $R^1$ and $R^2$ independently represent an alkyl group having 1 to 4 carbon atoms, which is substituted with an aromatic ring group or an unsubstituted alkyl group having 1 to 4 carbon atoms and may be combined with each other to form a heterocyclic group including a nitrogen atom; $Ar^1$, $Ar^2$ and $Ar^3$ represent a substituted or unsubstituted aromatic ring group; $R^3$ represents a hydrogen atom, a substituted or unsubstituted alkyl group having 1 to 4 carbon atoms or a substituted or unsubstituted aromatic ring group; l and m independently represent 0 or an integer from 1 to 3, and are not 0 at the same time; and n represents an integer from 1 to 3;

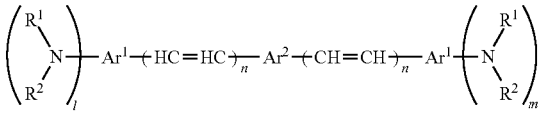

wherein $R^1$ and $R^2$ independently represent an alkyl group substituted with an aromatic hydrocarbon group or an unsubstituted alkyl group and may be combined with each other to form a heterocyclic group including a nitrogen atom; $Ar^1$ and $Ar^2$ represent a substituted or unsubstituted aromatic ring group; l and m independently represent 0 or an integer from 1 to 3, and are not 0 at the same time; and n represents 1 or 2;

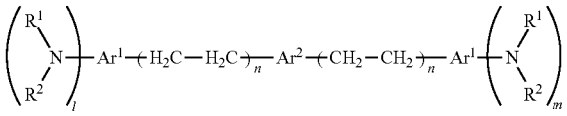

wherein $R^1$ and $R^2$ independently represent an alkyl group substituted with an aromatic hydrocarbon group or an unsubstituted alkyl group and may be combined with each other to form a heterocyclic group including a nitrogen atom; $Ar^1$ and $Ar^2$ represent a substituted or unsubstituted aromatic ring group; l and m independently represent 0 or an integer from 1 to 3, and are not 0 at the same time; and n represents 1 or 2; and

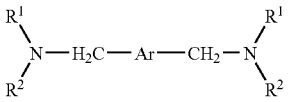

wherein $R^1$ and $R^2$ independently represent substituted or unsubstituted alkyl group and a substituted or unsubstituted aromatic hydrocarbon group, and one of $R^1$ and $R^2$ is a substituted or unsubstituted aromatic hydrocarbon group, and may be combined with each other to form a heterocyclic group including a nitrogen atom; and Ar represents a substituted or unsubstituted aromatic hydrocarbon group.

Specific examples of the alkyl group mentioned in the explanations of these formulae include a methyl group, an ethyl group, a propyl group, a butyl group, a hexyl group, an undecanyl group, etc. Specific examples of the aromatic hydrocarbon group include aromatic ring groups such as benzene, biphenyl, naphthalene, anthracene, fluorene and pyrene; and aromatic heterocyclic groups such as pyridine, quinoline, thiophene, furan, oxazole, oxadiazole and carbazole. Specific examples of their substituents include the above-mentioned specific examples of the alkyl group; an alkoxy group such as a methoxy group, an ethoxy group, a propoxy group and a butoxy group; a halogen atoms such as a fluorine atom, a chlorine atom, a bromine atom and an iodine atom; the above-mentioned aromatic hydrocarbon groups; and heterocyclic ring groups such as pyrrolidine, piperidine and piperazine. When $R^1$ and $R^2$ are combined with each other to form a heterocyclic group including a nitrogen atom, specific examples thereof include a condensed heterocyclic group such as pyrrolidino groups, piperidino groups and piperazino groups condensed with aromatic hydrocarbon groups.

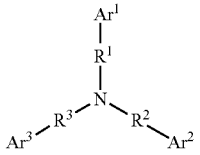

wherein $R^1$, $R^2$ and $R^3$ represent an alkylene group optionally having a substituent; and $Ar^1$, $Ar^2$ and $Ar^3$ represent an aryl group optionally having a substituent, and $Ar^3$ represents a condensed polycyclic group optionally having a substituent or a hetero atom.

Specific examples of the alkylene group represented by $R^1$, $R^2$ and $R^3$, optionally having a substituent include a methylene group, an ethylene group, a propylene group, etc. The aryl group represented by $Ar^1$, $Ar^2$ and $Ar^3$, optionally having a substituent include may be a condensed ring or a ring assembly having an aromatic ring. Specific examples thereof include a phenyl group, a naphthyl group, an anthryl group, a pyrenyl group, a perylenyl group, etc. The substituents of $Ar^1$, $Ar^2$ and $Ar^3$ may be combined with each other to form a ring.

$Ar^3$ represents a condensed polycyclic group optionally having a substituent or a hetero atom. The hetero atoms may be any hetero atoms theoretically applicable, and specific examples thereof include an oxygen atom, a sulfuric atom, a nitrogen atom, a phosphorus atom, etc. Specific examples of the condensed polycyclic group optionally having a substituent or a hetero atom include a naphthyl group, an anthryl group, a pyrenyl group, a perylenyl group, an acenaphthenyl group, a carbazolyl group, a quinolynyl group, a benzothienyl group, dibenzothienyl group, a indolyl group, a teterahydronaphthyl group, etc.

The alkylene group, aryl group and condensed polycyclic group represented by $R^1$, $R^2$, $R^3$, $Ar^1$, $Ar^2$ and $Ar^3$ may have substituents, and specific examples of the substituents include, but are not limited to, alkyl groups such as a methyl group, an ethyl group and a propyl group; alkoxy groups such as a methoxy group, an ethoxy group and a propoxy group; aryl groups such as a phenyl group and a naphthyl group; aralkyl groups such as a benzyl group; alkoxycarbonyl groups such as a methoxycarbonyl group and an ethoxycarbonyl group; aryloxy groups such as a phenoxy group; dialkylamino groups such as a diethylamino group and a diisopropylamino group, etc.

Specific examples of the compound having an amine site and the electrostatic potential thereof are shown the following Table 1.

TABLE 1
| No. | Formula | Electrostatic potential |
|---|---|---|
| 1 | 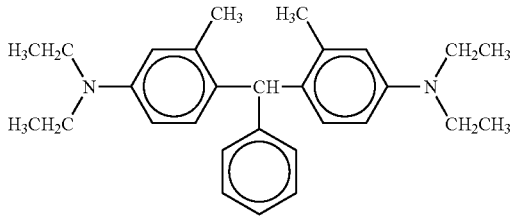 | −0.285 |
| 2 | 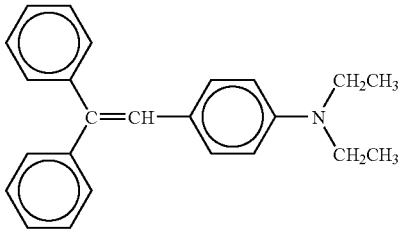 | −0.377 |
| 3 | 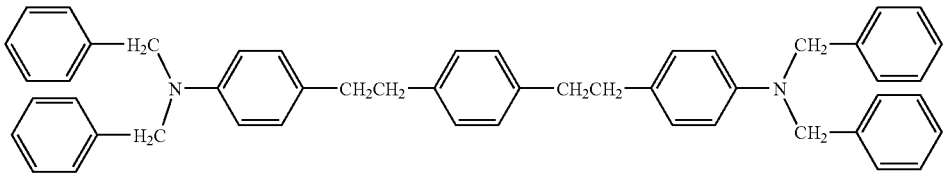 | −0.275 |
| 4 | 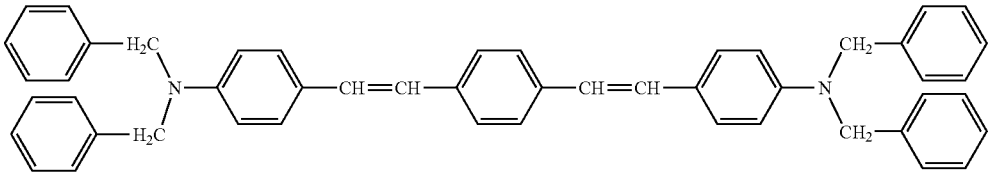 | −0.275 |
| 5 | 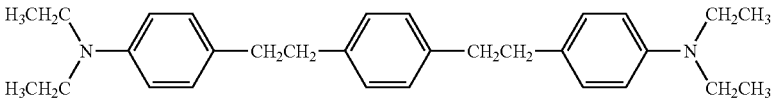 | −0.377 |
| 6 | 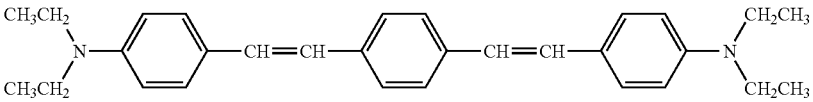 | −0.377 |
| 7 | 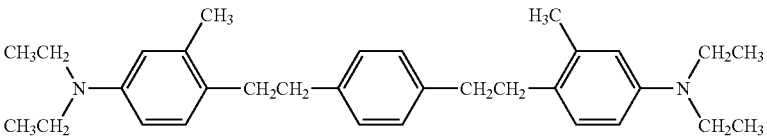 | −0.285 |
| 8 | 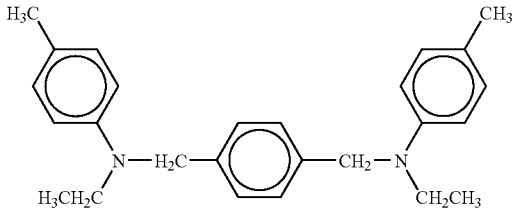 | −0.282 |

TABLE 1-continued

| No. | Formula | Electrostatic potential |
|---|---|---|
| 9 | 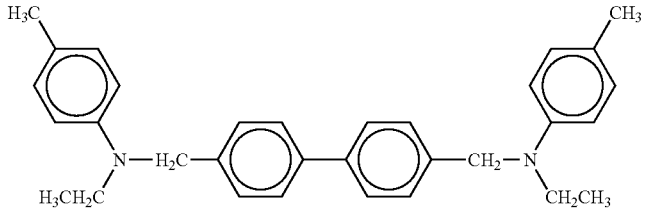 | −0.282 |

Specific examples of the CTM include compounds having the following formulae (C1) to (C26):

(C1)

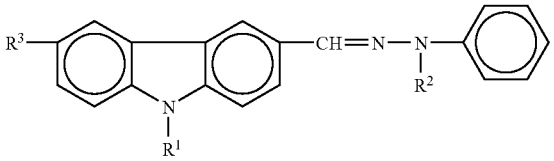

wherein $R^1$ represents a methyl group, an ethyl group, a 2-hydroxyethyl group or a 2-chlorethyl group; and $R^2$ represents a methyl group, an ethyl group, a benzyl group or a phenyl group; and $R^3$ represents a hydrogen atom, a chlorine atom, a bromine atom, an alkyl group having 1 to 4 carbon atoms, an alkoxy group having 1 to 4 carbon atoms, a dialkylamino group or a nitro group;

(C2)

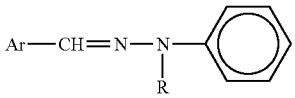

wherein Ar represents a naphthalene ring, an anthracene ring, a pyrene ring and their substituents, a pyridine ring, a furan ring or thiophene ring; and R represents an alkyl group, a phenyl group or a benzyl group;

(C3)

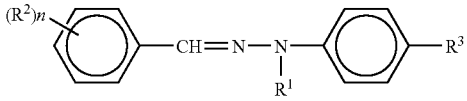

wherein $R^1$ represents an alkyl group, a benzyl group, a phenyl group or a naphtyl group; $R^2$ represents a hydrogen atom, an alkyl group having 1 to 3 carbon atoms, an alkoxy group having 1 to 3 carbon atoms, a dialkylamino group, diaralkylamino group or a diarylamino group; n represents an integer from 1 to 4 and $R^2$ may be the same or different from each other when n is not less than 2; and $R^3$ represents a hydrogen atom or a methoxy group;

(C4)

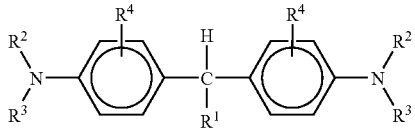

wherein $R^1$ represents an alkyl group having 1 to 11 carbon atoms, a substituted or unsubstituted phenyl group or a heterocyclic ring group; $R^2$ and $R^3$ independently represent a hydrogen atom, an alkyl group having 1 to 4 carbon atoms, a hydroxyalkyl group, a chloralkyl group or a substituted or unsubstituted aralkyl group, and may be combined with each other to form a heterocyclic ring group including a nitrogen atom; and $R^4$ independently represent a hydrogen atom, an alkyl group having 1 to 4 carbon atoms, an alkoxy group or a halogen atom;

(C5)

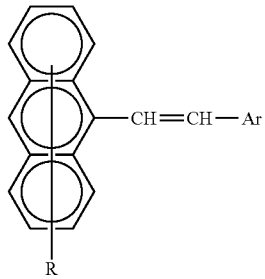

wherein R represents a hydrogen atom or a halogen atom; and Ar represents a substituted or unsubstituted phenyl group, a naphtyl group, an anthryl group or a carbazolyl group;

(C6)

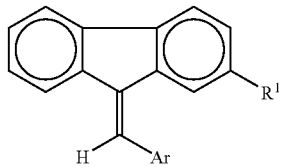

wherein $R^2$ represents a hydrogen atom, a cyano group, an alkoxy group having 1 to 4 carbon atoms or a alkyl group having 1 to 4 carbon atoms; and Ar represents a group having the following formulae (C7) or (C8):

(C7)

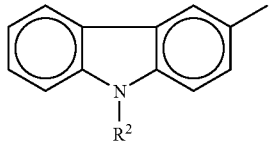

(C8)

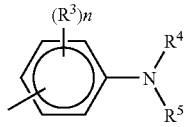

wherein $R^2$ represents an alkyl group having 1 to 4 carbon atoms; $R^3$ represents a hydrogen atom, a halogen atom, an alkyl group having 1 to 4 carbon atoms, an alkoxy group having 1 to 4 carbon atoms or a dialkylamino group; n is 1 or 2, and $R^3$ may be the same or different from each other when n is 2; and $R^4$ and $R^5$ represent a hydrogen atom, a substituted or unsubstituted alkyl group having 1 to 4 carbon atoms or a substituted or unsubstituted benzyl group;

(C9)

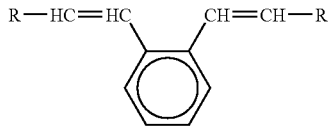

wherein R represents a carbazolyl group, a pyridyl group, a thienyl group, an indolyl group, a furyl group, a substituted or unsubstituted phenyl, styryl, naphtyl group or an anthryl group, and their substituents are selected from the group consisting of a dialkylamino group, an alkyl group, an alkoxy group, a carboxyl group or its ester, a halogen atom, a cyano group, an aralkylamino group, N-alkyl-N-aralkylamino group, an amino group, a nitro group and an acethylamino group.

(C10)

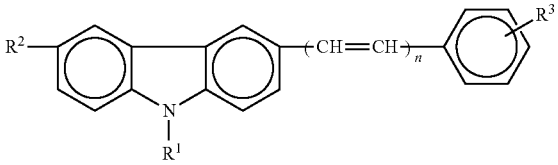

wherein $R^1$ represents a lower alkyl group, a substituted or unsubstituted phenyl group or a benzyl group; $R^2$ and $R^3$ represent a hydrogen atom, a lower alkyl group, a lower alkoxy group, a halogen atom, a nitro group, an amino group or an amino group substituted by a lower alkyl group or a benzyl group; and n is 1 or 2;

(C11)

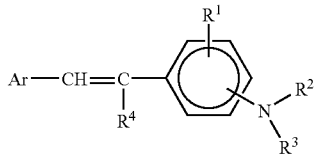

wherein $R^1$ represents a hydrogen atom, an alkyl group, an alkoxy group or a halogen atom; $R^2$ and $R^3$ represent a substituted or unsubstituted aryl group; $R^4$ represents a hydrogen atom, a lower alkyl group or a substituted or unsubstituted phenyl group; and Ar represents a substituted or unsubstituted phenyl group or a naphtyl group;

(C12)

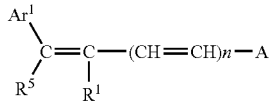

wherein n is 0 or 1; $R^1$ represents a hydrogen atom, an alkyl group or a substituted or unsubstituted phenyl group; $Ar^1$ represents a substituted or unsubstituted aryl group; $R^5$ represents an alkyl group having 1 to 4 carbon atoms or a substituted or unsubstituted aryl group; and A represents a 9-anthryl group, a substituted or unsubstituted carbazolyl group or a group having the following formula (C13a) or (C13b):

(C13a)

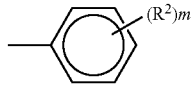

(C13b)

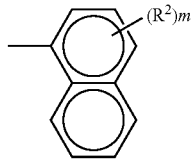

wherein $R^2$ represents a hydrogen atom, an alkyl group, an alkoxy group, a halogen atom or a group having the following formula; and m is an integer of from 1 to 3;

(C14)

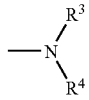

wherein $R^3$ and $R^4$ independently represent a substituted or unsubstituted aryl group, and $R^4$ may form a ring, and wherein $R^2$ may be the same or different from each other when m is not less than 2, and A and $R^1$ may form a ring together when n is 0;

(C15)

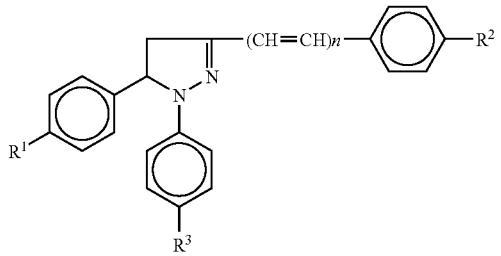

wherein $R^1$, $R^2$ and $R^3$ represent a hydrogen atom, a lower alkyl group, a lower alkoxy group, a halogen atom or a dialkylamino group; and n is 0 or 1;

(C16)

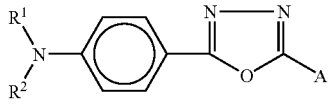

wherein $R^1$ and $R^2$ represent an alkyl group including a substituted alkyl group or a substituted or unsubstituted aryl group; and A represents a substituted amino group, a substituted or unsubstituted aryl group or an aryl group;

(C17)

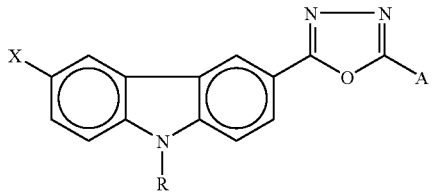

wherein X represents a hydrogen atom, a lower alkyl group or a halogen atom; R represents an alkyl group including a substituted alkyl group or a substituted or unsubstituted aryl group; and A represents a substituted amino group, a substituted or unsubstituted aryl group or an aryl group;

(C18)

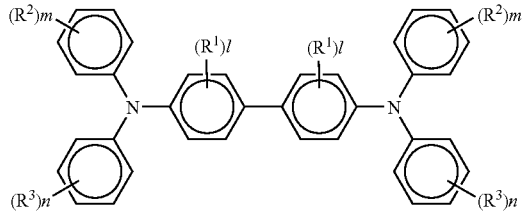

wherein $R^1$ represents a lower alkyl group, a lower alkoxy group or a halogen atom; $R^2$ and $R^3$ independently represent a hydrogen atom, a lower alkyl group, a lower alkoxy group or a halogen atom; and l, m and n independently represent 0 or an integer from 1 to 4;

(C19)

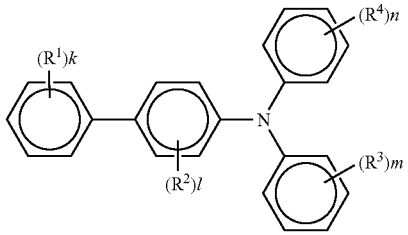

wherein $R^1$ $R^3$ and $R^4$ represent a hydrogen atom, an amino group, an alkoxy group, a thioalkoxy group, an aryloxy group, a methylenedioxy group, a substituted or unsubstituted alkyl group, a halogen atom or a substituted or unsubstituted aryl group; $R^2$ represents a hydrogen atom, an alkoxy group, a substituted or unsubstituted alkyl group or a halogen atom, but a case in which $R^1$, $R^2$, $R^3$ and $R^4$are all hydrogen atoms is excluded; and k, l, m, and n are independently an integer of from 1 to 4, and $R^1$, $R^2$, $R^3$ and $R^4$ may be the same or different from the others when k, l, m, and n are an integer from 2 to 4;

(C20)

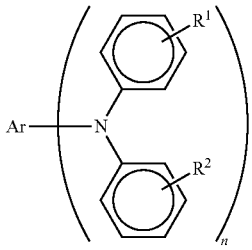

wherein Ar represents a condensation polycyclic hydrocarbon group having 18 or less carbon atoms which can have a substituent; and $R^1$ and $R^2$ independently represent a hydrogen atom, a halogen atom, a substituted or unsubstituted alkyl group, an alkoxy group, or a substituted or unsubstituted phenyl group and n is 1 or 2;

A-CH═CH—Ar—CH═CH-A (C21)

wherein Ar represents a substituted or unsubstituted aromatic hydrocarbon group; and A represents the following formula (C22):

(C22)

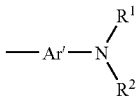

wherein $Ar^1$ represents a substituted or unsubstituted aromatic hydrocarbon group; and $R^1$ and $R^2$ represent substituted or unsubstituted alkyl group or a substituted or unsubstituted aryl group;

(C23)

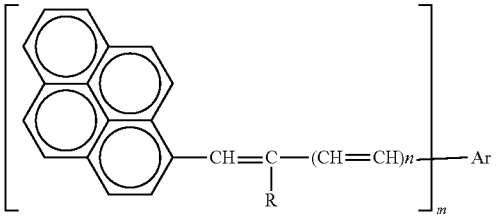

wherein Ar represents a substituted or unsubstituted aromatic hydrocarbon group; R represents a hydrogen atom, a substituted or unsubstituted alkyl group or a substituted or unsubstituted aryl group; n is 0 or 1; m is 1 or 2; and Ar and R may form a ring when n is 0 and m is 1.

Specific examples of the compound having formula (C1) include:

9-ethylcalbazole-3-aldehyde- 1-methyl-1-phenylhydrazone,
9-ethylcalbazole-3-aldehyde-1-benzyl-1-phenylhydrazone,
9-ethylcalbazole-3-aldehyde-1,1-diphenylhydrazone, etc.

Specific examples of the compound having formula (C2) include:

4-diethylaminostyryl-β-aldehhyde-1-methyl-1-phenylhydrazone,
4-methoxynaphthalene-1-aldehyde-1-benzyl-1-phenylhydrazone, etc.

Specific examples of the compound having formula (C3) include:

4-methoxybenzaldehyde-1-methyl-1-phenylhydrazone, 2,4-dimethoxybenzaldehyde-1-benzyl-1-phenylhydrazone,
4-diethylaminobenzaldehyde-1,1-diphenylhydrazone,
4-methoxybenzaldehyde-1-(4-methoxy)phenylhydrazone,
4-diphenylaminobenzaldehyde-1-benzyl-1-phenylhydrazone,
4-dibenzylaminobenzaldehyde-1,1-diphenylhydrazone, etc.

Specific examples of the compound having the formula (C4) include:

1,1-bis(4-dibenzylaminophenyl)propane, tris(4-diethylaminophenyl)methane,
1,1-bis(4-dibenzylaminophenyl)propane, 2,2'-dimethyl-4,4'-bis(diethylamino)-triphenylmethane, etc.

Specific examples of the compound having the formula (C5) include:

9-(4-diethylaminostyryl)anthracene,
9-bromo-10-(4-diethylaminostyryl)anthracene, etc.

Specific examples of the compound having the formula (C6) include:

9-(4-dimethylaminobenzylidene)fluorene,
3-(9-fluorenylidene)-9-ethylcarbazole, etc.

Specific examples of the compound having the formula (C9) include:

1,2-bis-(4-diethylaminostyryl)benzene,
1,2-bis(2-,4-dimethoxystyryl)benzene, etc.

Specific examples of the compound having the formula (C10) include:

3-styryl-9-ethylcarbazole, 3-(4-methoxystyryl)-9-ethylcarbazole, etc.

Specific examples of the compound having the formula (C11) include: 4-diphenylaminostilbene, 4-dibenzylaminostilbene, 4-ditolylaminostilbene, 1-(4-iphenylaminostyryl) naphthalene, 1-(4-diethylaminostyryl)naphthalene, etc.

Specific examples of the compound having the formula (C12) include: 4'-diphenylamino-α-ephenylstilbene, 4'-bis (4-methylphenyl)amino-α-phenylstilbene, etc.

Specific examples of the compound having the formula (C15) include: 1-phenyl-3-(4-diethylaminostyryl)-5-(4-diethylaminophenyl)pyrazoline, etc.

Specific examples of the compound having the formula (C16) include: 2,5-bis(4-diethylaminophenyl)-1,3,4-oxadiazole, 2-N,N-diphenylamino-5-(4-diethylaminophenyl)-1,3,4-oxadiazole, 2-(4-dimethylaminophenyl)-5-(4-diethylaminophenyl)-1,3,4-oxadiazole, etc.

Specific examples of the compound having the formula (C17) include: 2-N,N-diphenylamino-5-(N-ethylcarbazole-3-yl)-1,3,4-oxadiazole, 2-(4-diethylaminophenyl)-5-(N-ethylcarbazole-3-yl)-1,3,4-oxadiazole, etc.

Specific examples of the benzidine compound having the formula (C18) include:

N,N'-diphenyl-N,N'-bis(3-methylphenyl)-1,1'-biphenyl-4,4'-diamine,
3,3'-dimethyl-N,N,N',N'-tetrakis(4-methylphenyl)-1,1'-biphenyl-4,4'-diamine, etc.

Specific examples of the biphenylamine compound having the formula (C19) include:

4'-methoxy-N,N-diphenyl-1,1'-biphenyl]4-amine, 4'-methyl-N,N-bis(4-methylphenyl)-1,1'-biphenyl-4-amine, 4'-methoxy-N,N-bis(4-methylphenyl)-1,1'-biphenyl]-4-amine, N,N-bis(3,4-dimethylphenyl)-1,1'-biphenyl-4-amine, etc.

Specific examples of the triarylamine compound having the formula (C20) include:

N,N-diphenyl-pyrene-1-amine, N,N-di-p-tolyl-pyrne-1-amine,
N,N-di-p-tolyl-1-naphthylamine,
N,N-di(p-tolyl)-1-phenanthorylamine,
9,9-dimethyl-2-(di-p-tolylamino)fluorene,
N,N,N',N'-tetrakis(4-methylphenyl)-phenanthrene-9,10-diamine,
N,N,N',N'-tetrakis(3-methylphenyl)-m-phenylenediamine, etc.

Specific examples of the diolefin aromatic compound having the formula (C21) include: 1,4-bis(4-diphenylaminostyryl)benzene, 1,4-bis [4-di(p-tolyl)aminostyryl] benzene, etc. Specific examples of the styrylpyrene compound having the formula (C23) include 1-(4-diphenylaminostyryl) pyrene, 1-[4-di(p-tolyl)aminostyryl] pyrene, etc.

Specific examples of an electron transport material include: chloranil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-indeno [1,2-b] thiophene-4-one, and 1,3,7-trinitrodibenzothiophene-5,5-dioxide, etc. In addition, electron transport materials having the following formulae (C24), (C25) and (C26) are preferably used.

(C24)

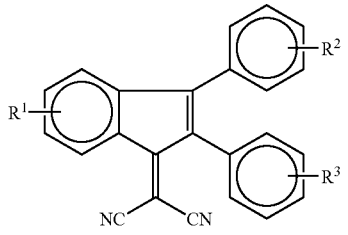

wherein $R^1$, $R^2$ and $R^3$ independently represent a hydrogen atom, a halogen atom, a substituted or unsubstituted alkyl group, an alkoxy group or a substituted or unsubstituted phenyl group;

(C25)

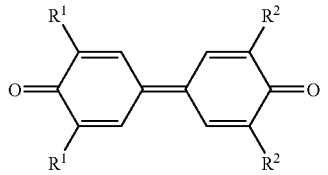

wherein $R^1$ and $R^2$ independently represent a hydrogen atom, a substituted or unsubstituted alkyl group, or a substituted or unsubstituted phenyl group;

(C26)

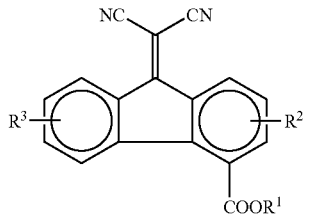

wherein $R^1$, $R^2$ and $R^3$ independently represent a hydrogen atom, a halogen atom, a substituted or unsubstituted alkyl group, an alkoxy group or a substituted or unsubstituted phenyl group.

These CTMs can be used alone or in combination.

Hereinafter, the electrophotographic photoreceptor, method of preparing the photoreceptor, image forming apparatus, image forming method and process cartridge for an image forming apparatus of an embodiment of the present invention will be explained in detail.

Layer compositions of the electrophotographic photoreceptor of an embodiment of the present invention will be explained, referring to FIGS. 1 to 5.

The electrophotographic photoreceptor of the present invention includes at least a photosensitive layer on an electroconductive substrate, and may include a protection layer at the surface of the photosensitive layer to improve the oxidizing gas and abrasion resistance thereof.

FIG. 1 is a cross-sectional view illustrating an embodiment of the photosensitive layer of the electrophotographic photoreceptor of the present invention, wherein a photosensitive layer 202 including a CGM and a CTM as the main components is formed on an electroconductive substrate 201.

Figure 2:
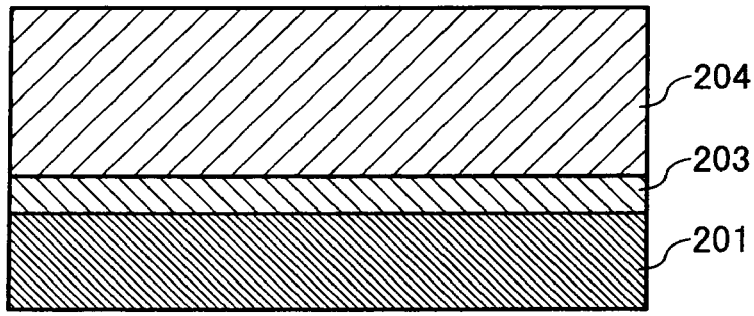
FIG. 2 is a cross-sectional view illustrating another embodiment of the photosensitive layer of the electrophotographic photoreceptor of the present invention.

FIG. 2 is a cross-sectional view illustrating another embodiment of the photosensitive layer of the electrophotographic photoreceptor of the present invention, wherein a CGL 203 including a CGM as the main component overlies a CTL 204 including a CTM as the main component on an electroconductive substrate 201.

Figure 3:
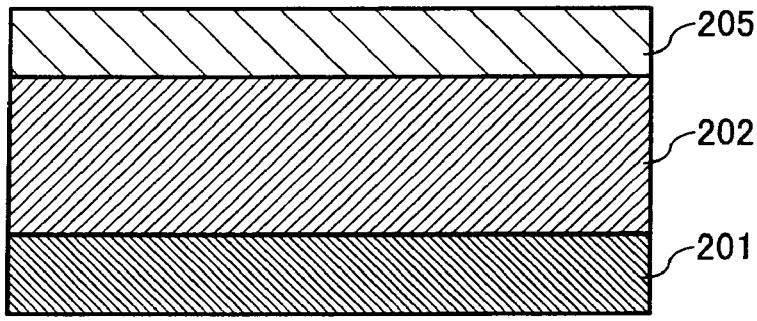
FIG. 3 is a cross-sectional view illustrating a further embodiment of the photosensitive layer of the electrophotographic photoreceptor of the present invention.

FIG. 3 is a cross-sectional view illustrating a further embodiment of the photosensitive layer of the electrophotographic photoreceptor of the present invention, wherein a photosensitive layer 202 including a CGM and a CTM as the main components is formed on an electroconductive substrate 201, and further a protection layer 205 is formed on the surface thereof. In this case, the protection layer 205 includes an amine compound of the present invention.

Figure 4:
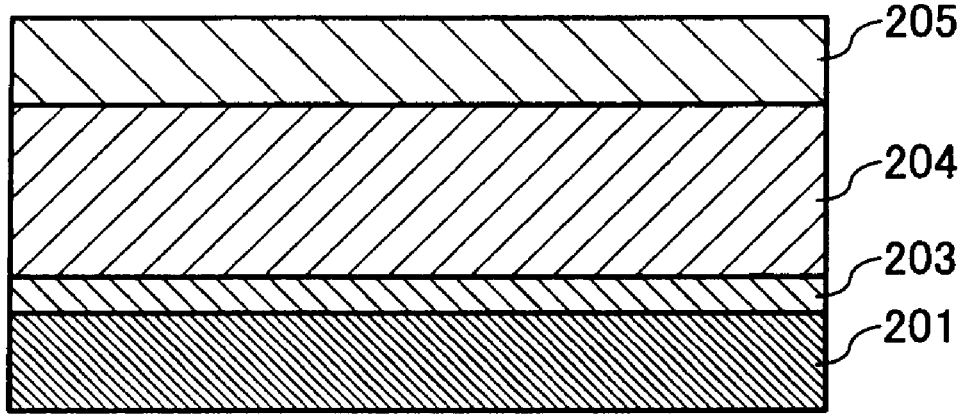
FIG. 4 is a cross-sectional view illustrating another embodiment of the photosensitive layer of the electrophotographic photoreceptor of the present invention.

FIG. 4 is a cross-sectional view illustrating another embodiment of the photosensitive layer of the electrophotographic photoreceptor of the present invention, wherein a CGL 203 including a CGM as the main component, a CTL 204 including a CTM as the main component overlying the CGL, and further a protection layer 205 overlying the CTL are formed on an electroconductive substrate 201. In this case, the protection layer 205 includes an amine compound of the present invention.

Figure 5:
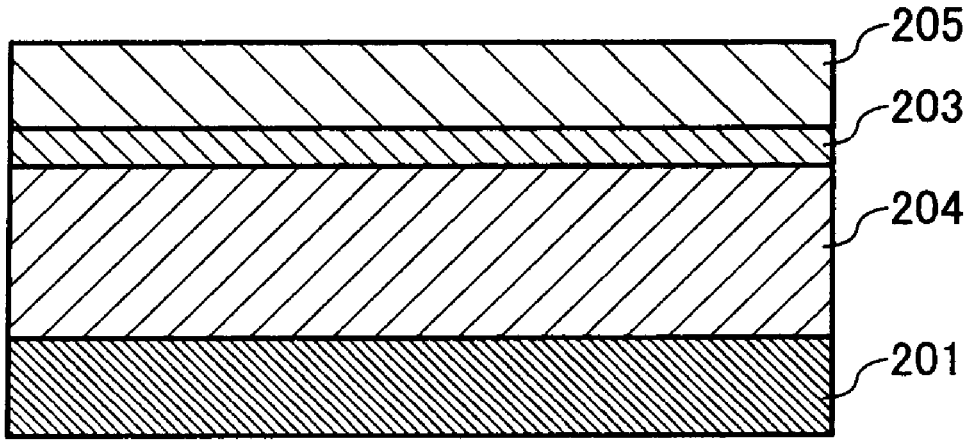
FIG. 5 is a cross-sectional view illustrating a further embodiment of the photosensitive layer of the electrophotographic photoreceptor of the present invention.

FIG. 5 is a cross-sectional view illustrating a further embodiment of the photosensitive layer of the electrophotographic photoreceptor of the present invention, wherein, a CTL 204 including a CTM as the main component, a CGL 203 including a CGM as the main component overlying the CTL, and further a protection layer 205 overlying the CGL are formed on an electroconductive substrate 201. In this case, the protection layer 205 includes an amine compound of the present invention.

Suitable materials for use as the electroconductive substrate 201 include materials having a volume resistance not greater than $10^{10}$ Ω·* cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can be also used as the substrate. Further, endless belts of a metal such as nickel and stainless steel, which have been disclosed in Japanese Laid-Open Patent Publication No. 52-36016, can be also used as the electroconductive substrate 201.

Furthermore, substrates, in which a coating liquid including a binder resin and an electroconductive powder is coated on the supporters mentioned above, can be used as the substrate 201. Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can be also used as the electroconductive substrate of an embodiment of the present invention.

In the photoreceptor of an embodiment of the present invention, an undercoat layer may be formed between the substrate and the photosensitive layer. The undercoat layer includes a resin as a main component. Since a photosensitive layer is typically formed on the undercoat layer by coating a liquid including an organic solvent, the resin in the undercoat layer preferably has good resistance against general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like. The undercoat layer may include a fine powder of metal oxides such as titanium oxide, silica, alumina, zirconium oxide, tin oxide and indium oxide to prevent occurrence of moiré in the recorded images and to decrease residual potential of the photoreceptor.

The undercoat layer can be formed by coating a coating liquid using a proper solvent and a proper coating method similarly to those for use in formation of the photosensitive layer mentioned above. The undercoat layer may be formed using a silane coupling agent, titanium coupling agent or a chromium coupling agent. In addition, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the undercoat layer. The thickness of the undercoat layer is preferably 0 to 5 μm.

The photosensitive layer may be single-layered or multi-layered. The multi-layered photosensitive layer includes a CGL 203 having charge generatability and a CTL 204 having charge transportability. The single-layered photosensitive layer 202 has both charge generatability and charge transportability.

Hereinafter, each of the multi-layered photosensitive layer and single-layered photosensitive layer will be explained.

The CGL 203 includes a charge generation material as a main component. In the CGL 203, known charge generation materials can be used. Specific examples of such charge generation materials include, but are not limited to, monoazo pigments, disazo pigments, trisazo pigments, perylene pigments, perynone pigments, quinacridone pigments, quinone type condensed polycyclic compounds, squaric acid type dyes, other phthalocyanine pigments, naphthalocyanine pigments, azulenium salt type dyes, and the like pigments and dyes. These charge generation materials can be used alone or in combination.

The CGL 203 can be prepared by dispersing a charge generation material in a proper solvent optionally together with a binder resin using a ball mill, an attritor, a sand mill or a supersonic disperser, coating the coating liquid on an electroconductive substrate and then drying the coated liquid.

Suitable binder resins optionally for use in the CGL 203 include polyamides, polyurethanes, epoxy resins, polyketones, polycarbonates, silicone resins, acrylic resins, polyvinyl butyral, polyvinyl formal, polyvinyl ketones, polystyrene, polysulfone, poly-N-vinylcarbazole, polyacrylamide, polyvinyl benzal, polyesters, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins.

The CGL 203 preferably includes the binder resin from 0 to 500 parts by weight, and preferably from 10 to 300 parts by weight per 100 parts by weight of the charge generation material.

Suitable solvents for use in the coating liquid for preparing the CGL can include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and like solvents. In particular, ketone type solvents, ester type solvents and ether type solvents are preferably used. These can be used alone or in combination.

The CGL 203 includes a charge generation material, a solvent and a binder resin as main components, and may include any additives such as a sensitizer, a disperser, a surfactant and a silicone oil.

The coating liquid can be coated by a coating method such as dip coating, spray coating, bead coating, nozzle coating, spinner coating and ring coating.

The CGL 203 preferably has a thickness of from 0.01 to 5 μm, and more preferably from 0.1 to 2 μm.

The CTL 204 can be formed by dissolving or dispersing a charge transport material and a binder resin in a proper solvent coating the coating liquid on the CGL 203 and drying the coated liquid. Additives such as plasticizers, leveling agents and antioxidants can be optionally included in the coating liquid alone or in combination.

Specific examples of the binder resin include, but are not limited to, thermoplastic or thermosetting resins such as ABS resins, ACS resins, olefin-vinyl monomer copolymers, chlorinated polyethers, aryl resins, phenolic resins, polyacetal, polyamide, polyamideimide, polyacrylate, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins, styrene-acrylonitrile copolymers, styrene-maleic anhydride copolymers, polyester, vinyl chloride-vinyl acetate copolymers, polyvinyl acetate, phenoxy resins, cellulose acetate resins, ethyl cellulose resins, polyvinyl butyral, polyvinyl formal, polyvinyl toluene, poly-N-vinyl carbazole, acrylic resins, silicone resins, melamine resins, alkyd resins, etc.

The CTL preferably includes the CTM from 20 to 300 parts by weight, and more preferably from 40 to 150 parts by weight per 100 parts by weight of the binder resin. The CTL preferably has a thickness not greater than 25 μm in view of resolution of the resultant images and response. The lower limit of the thickness is preferably not less than 5 μm, although it depends on the image forming system (particularly on a charged potential of the electrophotographic photoreceptor).

Specific examples of a solvent for use in forming the CTL include tetrahydrofuran, dioxane, toluene, dichloromethane, monochlorobenzene, dichloroethane, cyclohexanone, methyl ethyl ketone, acetone and the like solvents. These can be used alone or in combination.

As a method of coating the thus prepared coating liquid, a conventional coating method such as a dip coating method, a spray coating method, a bead coating method, a nozzle coating method, a spinner coating method and a ring coating method can be used.

Next, a single-layered photosensitive layer in FIG. 1 will be explained. A photoreceptor in which the above-mentioned CGM is dispersed in the binder resin can be used.

The photosensitive layer can be formed by coating a coating liquid in which a CGM, a CTM and a binder resin are dissolved or dispersed in a proper solvent, and then drying the coated liquid. In addition, the photosensitive layer may optionally include additives such as plasticizers, leveling agents and antioxidants.

The CTMs mentioned in the CTL 204 can be used. Suitable binder resins can include, for example, the resins mentioned above in the CTL 204. The resins mentioned above in the CGL 203 can be added as a binder resin. The photosensitive layer preferably includes a CGM from 5 to 40 parts by weight, a CTM from 0 to 190, and more preferably from 50 to 150 parts by weight per 100 parts by weight of the binder resin. The single-layered photosensitive layer can be formed by coating a coating liquid in which a CGM, a binder resin and a CTM are dissolved or dispersed in a solvent such as tetrahydrofuran, dioxane, dichloroethane, cyclohexane, etc. by a coating method such as a dip coating method, spray coating method, a bead coating method and a ring coating method. The thickness of the photosensitive layer is preferably from 5 to 25 μm.

Next, the protection layer which is an outermost layer of the photosensitive layer will be explained. The protection layer can include an amine compound and a filler to increase the abrasion resistance thereof. In addition, the protection layer can include at least an organic compound having an acid value of from 10 to 700 (mg KOH/g) as a dispersant.

Specific examples of the organic filler materials include, for example, a fluorocarbon resin powder such as polytetrafluoroethylene, a silicone resin powder and an α-carbon powder. Specific examples of inorganic filler materials include, for example, metallic powders such as copper, tin, aluminium and indium; metal oxides such as silica, tin oxide, zinc oxide, titanium oxide, alumina, zirconium oxide, indium oxide, stibium oxide, bismuth oxide, calcium oxide, zinc oxide doped with stibium and indium oxide doped with zinc; metal fluorides such as zinc fluoride, calcium fluoride and aluminium fluoride; and inorganic materials such as kalium titanate and boron nitride. Among these fillers, inorganic materials are advantageously used in terms of process efficiency and hardness of the filler to improve abrasion resistance of the resultant photoreceptor.

Further, highly-insulative fillers such as titanium oxide, alumina, zinc oxide and zirconium oxide are preferably used. These fillers can be used alone or in combination. Among these fillers, an α-type alumina with a hexagonal close-packed structure having a high insulation, heat resistance and abrasion resistance is preferably used in terms of preventing blurred images and improving abrasion resistance.

The filler preferably has an average primary particle diameter from 0.01 to 1.0 μm, more preferably from 0.1 to 0.5 μm, and furthermore preferably from 0.3 to 0.5 μm in terms of light transmittance and abrasion resistance of the protection layer. When less than 0.01 μm, the abrasion resistance of the resultant protection layer and the dispersibility of the filler in a dispersion liquid deteriorate. When greater than 0.5 μm, the sedimentation of the filler is accelerated and filming of a toner over the protection layer possibly occurs.

The protection layer preferably includes a filler of 0.1 to 50% by weight, and more preferably from 5 to 30% by weight. When less than 0.1% by weight, the protection layer does not have sufficient abrasion resistance. When greater than 50% by weight, the transparency of the protection layer is possibly impaired.

These fillers are preferably treated with at least one dispersant to improve the dispersibility thereof and prevent an increase of residual potential caused thereby. The lower dispersibility of the filler not only increases the residual potential, but also causes lower transparency and defects of the protection layer, and further causes lower abrasion resistance thereof, possibly resulting in serious problems disturbing the durability of photoreceptors and the quality of images.

Next, an organic compound having an acid value of 10 to 700 (mg KOH/g) as a dispersant will be explained. The organic compound having an acid value of 10 to 700 (mg KOH/g) included in the protection layer can prevent an increase in residual potential caused by including a filler therein. The acid value is defined by a mg of potassium hydroxide required to neutralize a free fatty acid included in 1 g of the compound.

Any known organic compounds having an acid value from 10 to 700 (mg KOH/g) such as organic fatty acids and resins having a high acid value can be used. However, since it is probable that a very low-molecular-weight organic acid such as a maleic acid, a citric acid, a tartaric acid and succinic acid or an acceptor largely decreases dispersibility of the filler, in some cases, it does not sufficiently decrease the residual potential. Therefore, in order to decrease residual potential of a photoreceptor and increase dispersibility of the filler, a low-molecular-weight polymer, a resin, a copolymer and their mixtures are preferably used.

The organic compound preferably has a linear structure with few steric exclusions. In order to increase the dispersibility, both the filler and the binder resin have to have affinity. A material having a large steric exclusion decreases the affinity and deteriorates the dispersibility, resulting in the occurrence of the above-mentioned multitude of problems. A polycarboxylic acid is preferably used as the organic compound having an acid value of 10 to 700 (mg KOH/g). The polycarboxylic acid is an organic compound having two or more carboxyl groups or a compound having a structure including a carboxylic acid in its polymer or copolymer, and any organic compounds including a carboxylic acid or their derivatives such as polyester resins, acrylic resins, copolymers using an acrylic acid or a methacrylic acid and styrene acrylic copolymers can be used. These can be effectively used in combination. In some cases a mixture of these materials and an organic fatty acid increases dispersibility of the filler and decreases the residual potential.

In the present invention, the organic compound having an acid value from 10 to 700 (mg KOH/g) is used, and an organic compound having an acid value from 30 to 300 (mg KOH/g) is most preferably used. When the acid value is higher than necessary, the resistance is decreased too much and blurred images are produced. When the acid value is too low, the content has to be increased and the residual potential is nor sufficiently decreased. In addition, the acid value of the material has to be determined based on a balance with the above-mentioned content. A higher acid value does not always reduce the residual potential effectively, and the reduction of residual potential largely depends upon a sorbability of the organic compound having an acid value from 10 to 700 (mg KOH/g) to a filler.

The filler material included in the protection layer can be dispersed with at least an organic solvent and the organic compound having an acid value of 10 to 700 (mg KOH/g) using a conventional method such as a ball mill, an attritor, a sand mill and a supersonic. Among these methods, the ball mill with little interfusion of impurities from outside, which can increase a contact efficiency of the filler and the organic compound having an acid value from 10 to 700 (mg KOH/g) is preferably used in terms of dispersibility. Any conventional media such as a zirconia, an alumina and an agate can be used, however, in particular, the alumina is preferably used in terms of dispersibility of the filler and reduction of the residual potential. The zirconia is largely abraded when dispersed and remarkably increases the residual potential. Further, the abraded powder is mixed, and the dispersibility largely deteriorates and sedimentation of the filler is accelerated. To the contrary, when alumina is used as the media, the alumina is abraded when dispersed, but the abraded amount is low and the abraded powder scarcely affect the residual potential. In addition, the abraded powder scarcely affect the dispersibility. Therefore, the alumina is preferably used as a media for use in the dispersion.

The organic compound having an acid value of 10 to 700 (mg KOH/g) is preferably included in the coating liquid before dispersion because of preventing agglomeration and sedimentation of the filler and noticeably improving dispersibility of the filler. To the contrary, the binder resin and the charge transport material can be included in the coating liquid before dispersion. However, in this case, dispersibility slightly deteriorates, and therefore, the binder resin and the charge transport material is preferably included in the coating liquid after dispersion in a state of being dissolved in an organic solvent.

When a coating liquid including the compound having an amine site and the organic compound having an acid value of 10 to 700 (mg KOH/g) has to be stored, a specific antioxidant has to be included in the coating liquid to prevent salt production due to the interaction. The salt production causes not only a discoloration of the coating liquid but also an increase of residual potential of the resultant electrophotographic photoreceptor. The temporal storage instability of the coating liquid due to the salt production is caused by constitutions of the compound having an amine site, and can be solved by including the antioxidant in the coating liquid.

Typical antioxidants mentioned later can be used as the antioxidant for use in the present invention. Among the antioxidants, hindered phenol compounds are effectively used. However, these antioxidants are used to protect the compound having an amine site in the coating liquid, which is a different purpose from a purpose mentioned later. Therefore, these antioxidants are preferably included in the coating liquid before the compound having an amine site is included therein. A content of the antioxidants is preferably 0.1 to 200% by weight per 100% by weight of the organic compound having an acid value of 10 to 700 (mg KOH/g) to exert temporal storage stability of the coating liquid.

Specific examples, for example, of the binder resin for use in the protection layer include thermoplastic or thermosetting resins such as ABS resins, ACS resins, olefin-vinyl monomer copolymers, chlorinated polyethers, aryl resins, phenolic resins, polyacetal, polyamide, polyamideimide, polyacrylate, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins, styrene-acrylonitrile copolymers, styrene-maleic anhydride copolymers, polyester, vinyl chloride-vinyl acetate copolymers, polyvinyl acetate, phenoxy resins, cellulose acetate resins, ethyl cellulose resins, polyvinyl butyral, polyvinyl formal, polyvinyl toluene, poly-N-vinyl carbazole, acrylic resins, silicone resins, melamine resins, alkyd resins, etc.

In the photoreceptor of an embodiment of the present invention, an intermediate layer may be formed between the photosensitive layer and the protection layer. The intermediate layer includes a resin as a main component. Specific examples of the resin include, for example, polyamides, alcohol soluble nylons, water-soluble polyvinyl butyral, polyvinyl butyral, polyvinyl alcohol, and the like. The intermediate layer can be formed by one of the above-mentioned known coating methods. The thickness of the intermediate layer is preferably from 0.05 to 2 μm.

In the photoreceptor of an embodiment of the present invention, antioxidants, plasticizers, lubricants, ultraviolet absorbents and leveling agents can be included in each layer such as the CGL, CTL, undercoat layer, protection layer and intermediate layer for environmental improvement, above all for the purpose of preventing a decrease of photosensitivity and increase of residual potential. Such compounds will be shown as follows.

Suitable antioxidants for use in the layers of the photoreceptor include but are not limited to, the following compounds:

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methyl ene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl) propionate]methane, bis[3,3'-bis(4'-hydroxy-3'-t-butylphenyl)butyric acid]glycol ester, tocophenol compounds, etc.

(b) Paraphenylenediamine Compounds

N-phenyl-N'-isopropyl-p-phenylenediamine,

N,N'-di-sec-butyl-p-phenylenediamine,

N-phenyl-N-sec-butyl-p-phenylenediamine,

N,N'-di-isopropyl-p-phenylenediamine,

N,N'-dimethyl-N,N'-di-t-butyl-p-phenylenediamine, etc.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, etc.

(d) Organic Sulfur-containing Compounds

Dilauryl-3,3'-thiodipropionate, distearyl-3,3'-thiodipropionate, ditetradecyl-3,3'-thiodipropionate, etc.

(e) Organic Phosphorus-containing Compounds

Triphenylphosphine, tri(nonylphenyl)phosphine, tri(dinonylphenyl)phosphine, tricresylphosphine, tri(2,4-dibutylphenoxy)phosphine, etc.

Suitable plasticizers for use in the layers of the photoreceptor include, but are not limited to, the following compounds:

(a) Phosphoric Acid Esters Plasticizers

Triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, etc.

(b) Phthalic Acid Esters Plasticizers

Dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, etc.

(c) Aromatic Carboxylic Acid Esters Plasticizers

Trioctyl trimellitate, tri-n-octyl trimellitate, octyl oxybenzoate, etc.

(d) Dibasic Fatty Acid Esters Plasticizers

Dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxy-ethyl sebacate, dioctyl succinate, diisodecyl succinate, dioctyl tetrahydrophthalate, di-n-octyl tetrahydrophthalate, etc.

(e) Fatty Acid Ester Derivatives

Butyl oleate, glycerin monooleate, methyl acetylricinolate, pentaerythritol esters, dipentaerythritol hexaesters, triacetin, tributyrin, etc.

(f) Oxyacid Esters Plasticizers

Methyl acetylricinolate, butyl acetylricinolate, butylphthalylbutyl glycolate, tributyl acetylcitrate, etc.

(g) Epoxy Plasticizers

Epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, etc.

(h) Dihydric Alcohol Esters Plasticizers

Diethylene glycol dibenzoate, triethylene glycol di-2-ethylbutyrate, etc.

(i) Chlorine-containing Plasticizers

Chlorinated paraffin, chlorinated diphenyl, methyl esters of chlorinated fatty acids, methyl esters of methoxychlorinated fatty acids, etc.

(j) Polyester Plasticizers

Polypropylene adipate, polypropylene sebacate, acetylated polyesters, etc.

(k) Sulfonic Acid Derivatives

P-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, etc.

(l) Citric Acid Derivatives

Triethyl citrate, triethyl acetylcitrate, tributyl citrate, tributyl acetylcitrate, tri-2-ethylhexyl acetylcitrate, n-octyldecyl acetylcitrate, etc.

(m) Other Compounds

Terphenyl, partially hydrated terphenyl, camphor, 2-nitro diphenyl, dinonyl naphthalene, methyl abietate, etc.

Suitable lubricants for use in the layers of the photoreceptor include, but are not limited to, the following compounds:

(a) Hydrocarbon Compounds

Liquid paraffins, paraffin waxes, micro waxes, low molecular weight polyethylenes, etc.

(b) Fatty Acid Compounds

Lauric acid, myristic acid, palmitic acid, stearic acid, arachidic acid, behenic acid, etc.

(c) Fatty Acid Amide Compounds

Stearic acid amide, palmitic acid amide, oleic acid amide, methylenebisstearamide, ethylenebisstearamide, etc.

(d) Ester Compounds

Lower alcohol esters of fatty acids, polyhydric alcohol esters of fatty acids, polyglycol esters of fatty acids, etc.

(e) Alcohol Compounds

Cetyl alcohol, stearyl alcohol, ethylene glycol, polyethylene glycol, polyglycerol, etc.

(f) Metallic Soaps

Lead stearate, cadmium stearate, barium stearate, calcium stearate, zinc stearate, magnesium stearate, etc.

(g) Natural Waxes

Carnauba wax, candelilla wax, beeswax, spermaceti, insect wax, montan wax, etc.

(h) Other Compounds

Silicone compounds, fluorine compounds, and the like.

Suitable ultraviolet absorbing agents for use in the layers of the photoreceptor include, but are not limited to, the following compounds:

(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, etc.

(b) Salicylate Compounds

Phenyl Salicylate, 2,4-di-t-butylphenyl-3,5-di-t-butyl-4-hydroxybenzoate, etc.

(c) Benzotriazole Compounds (2'-hydroxyphenyl)benzotriazole, (2'-hydroxy-5'-methylphenyl)benzotriazole, (2'-hydroxy-3'-t-butyl-5'-methylphenyl)-5-chlorobenzotriazole, etc.

(d) Cyano Acrylate Compounds

Ethyl-2-cyano-3,3-diphenyl acrylate, methyl-2-carbomethoxy-3-(paramethoxy) acrylate, etc.

(e) Quenchers (Metal Complexes)

Nickel(2,2'-thiobis(4-t-octyl)phenolate)-n-butylamine, nickeldibutyldithiocarbamate, cobaltdicyclohexyldithiophosphate, etc.

(f) HALS (Hindered Amines)

Bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, etc.

Next, the image forming method and image forming apparatus of an embodiment of the present invention will be explained in detail, referring to the drawings.

The image forming apparatus of an embodiment of the present invention can include at least an electrophotographic photoreceptor, an electrostatic latent image former, an image developer, a transferer and a fixer, and optionally includes other means such as a discharger, a cleaner, a recycler and a controller.

The image forming method of an embodiment of the present invention can include at least an electrostatic latent image forming process, a development process, a transfer process and a fixing process; and optionally includes other processes such as a discharge process, a cleaning process, a recycle process and a control process.

The image forming method of an embodiment of the present invention is preferably performed by the image forming apparatus of the present invention. The electrostatic latent image forming process is performed by the electrostatic latent image former. The development process is performed by the image developer. The transfer process is performed by the transferer. The fixing process is performed by the fixer. The other processes are performed by the other means.

The electrostatic latent image forming process is a process of forming an electrostatic latent image on an electrophotographic photoreceptor.

The electrophotographic photoreceptor is the electrophotographic photoreceptor of the present invention.

The electrostatic latent image is formed by uniformly charging the surface of the electrophotographic photoreceptor and irradiating the surface thereof with imagewise light by the electrostatic latent image former.

The electrostatic latent image former can include at least a charger uniformly charging the surface of the electrophotographic photoreceptor and an irradiator irradiating the surface thereof with the imagewise light.

The surface of the electrophotographic photoreceptor can be charged by the charger upon application of voltage.

The charger is not particularly limited, and can be selected in accordance with the purpose, e.g., known contact chargers such as an electroconductive or semiconductive rollers, bushes, films and chargers with a rubber blade; and non-contact chargers using a corona discharge such as corotron and scorotron can be used.

A roller charger equipped with a gap applicator such as a gap tape at the ends and located close to an electrophotographic photoreceptor through the gap tape can also be used.

The charger may have any shape besides the roller such as magnetic brushes and fur brushes, and is selectable according to a specification or a form of the electrophotographic image forming apparatus. The magnetic brush is formed of various ferrite particles such as Zn—Cu ferrite as a charging member, a non-magnetic electroconductive sleeve supporting the charging member and a magnet roll included by the non-magnetic electroconductive sleeve. The fur brush is a charger formed of a shaft subjected to an electroconductive treatment and a fur subjected to an electroconductive treatment with, e.g., carbon, copper sulfide, metals and metal oxides winding around or adhering to the shaft.

The surface of the electrophotographic photoreceptor is irradiated with the imagewise light by the irradiator.

The irradiator is not particularly limited, and can be selected in accordance with the purpose, provided that the irradiator can irradiate the surface of the electrophotographic photoreceptor with the imagewise light, such as reprographic optical irradiators, rod lens array irradiators, laser optical irradiators and a liquid crystal shutter optical irradiators.

In an embodiment of the present invention, a backside irradiation method irradiating the surface of the electrophotographic photoreceptor through the backside thereof may be used.

The developing process is a process of forming a visible image by developing the electrostatic latent image with a toner or a developer.

The visible image is formed by the image developer developing the electrostatic latent image with the toner or developer.

The image developer is not particularly limited, and can be selected from known image developers, provided that the image developer can develop with the toner or developer. For example, an image developer containing the toner or developer and being capable of imparting the toner or developer to the electrostatic latent image in contact or not in contact therewith is preferably used.

The image developer may use a dry developing method or a wet developing method, and may develop a single color or multiple colors. For example, an image developer including a stirrer, stirring the toner or developer to be charged and a rotatable magnet roller is preferably used.

In the image developer, the toner and the carrier are mixed and stirred, and the toner is charged and held on the surface of the rotatable magnet roller in the shape of an ear to form a magnetic brush. Since the magnet roller is located close to the electrostatic latent image bearer (photoreceptor), a part of the toner is electrically attracted to the surface thereof. Consequently, the electrostatic latent image is developed with the toner to form a visible image thereon.

The developer contained in the image developer may be a one-component developer or a two-component developer.

It is preferable that the visible image is firstly transferred onto an intermediate transferer and secondly transferred onto a recording medium thereby. It is more preferable that two or more visible color images are firstly and sequentially transferred onto the intermediate transferer and the resultant complex full-color image is transferred onto the recording medium thereby.

The visible image is transferred by the transferer using a transfer charger charging the electrostatic latent image bearer (photoreceptor). The transferer preferably includes a first transferer transferring the two or more visible color images onto the intermediate transferer and a second transferer transferring the resultant complex full-color image onto the recording medium.

The intermediate transferer is not particularly limited, and can be selected from known transferers in accordance with the purpose, such as a transfer belt.

The intermediate transferer preferably has a static friction coefficient of 0.1 to 0.6, and more preferably from 0.3 to 0.5. In addition, the intermediate transferer preferably has a volume resistance of from several to $10^3$ Ω·cm. When the intermediate transferer has a volume resistivity of several to $10^3$ Ω·cm, it is prevented that the intermediate transferer itself is charged and a charge is difficult to remain thereon to prevent an uneven second transfer. Further, a transfer bias can easily be applied thereto.

Materials therefor are not limited and any, for example, known materials can be used. Specific examples thereof include (1) a single layer belt formed of a material having high Young's modulus (tensile elasticity) such as PC (polycarbonate), PVDF (polyvinylidenefluoride), PAT (polyalkyleneterephthalate), a mixture of PC and PAT, a mixture of ETFE (ethylenetetrafluoroethylene copolymer) and PC, a mixture of ETFE and PAT, a mixture of PC and PAT and a thermosetting polyimide in which carbon black dispersed, which has a small transformed amount against a stress when an image is formed; (2) a two or three layer belt including a surface layer or an intermediate layer based on the above-mentioned belt having high Young's modulus, which prevents hollow line images due to a hardness of the single layer belt; and (3) a belt formed of a rubber and an elastomer having a comparatively low Young's modulus, which has an advantage of scarcely producing hollow line images due to its softness, and being low-cost because of not needing a rib or a meandering inhibitor when the belt is wider than a driving roller and an extension roller such that an elasticity of an edge of the belt projecting therefrom prevents meandering.

The intermediate transfer belt is conventionally formed of a fluorocarbon resin, a polycarbonate resin and a polyimide resin. However, an elastic belt which is wholly or partially an elastic member has been used recently.

A full-color image is typically formed of 4 colored toners. The full-color image includes 1 to 4 toner layers. The toner layer receives pressure from a first transfer (transfer from a photoreceptor to an intermediate transfer belt) and a second transfer (from the intermediate transfer belt to a sheet), and agglutinability of the toner increases, resulting in production of hollow letter images and edgeless solid images. Since a resin belt has a high hardness and does not transform according to a toner layer, it tends to compress the toner layer, resulting in possible production of hollow letter images.

Recently, demands for forming an image on various sheets such as a Japanese paper and a sheet purposefully having a concavity and convexity are increasing. However, paper having poor smoothness tends to have an air gap with toner when transferred thereon and hollow images tend to be produced thereon. When transfer pressure of the second transfer is increased to increase an adhesion of the toner to the paper, agglutinability of the toner increases, resulting in the production of hollow letter images.

The elastic belt transforms according to a toner layer and a sheet having a poor smoothness at a transfer point. Since the elastic belt transforms following to a local concavity and convexity, it adheres toner to paper well without giving excessive transfer pressure to a toner layer, and therefore a transfer image with good uniformity can be formed even on a sheet having poor smoothness, without hollow letter images.

Specific examples of a resin for the elastic belt include, for example: polycarbonate; fluorocarbon resins such as ETFE and PVDF; styrene resins (polymers or copolymers including styrene or a styrene substituent) such as polystyrene, chloropolystyrene, poly-α-methylstyrene, a styrene-butadiene copolymer, a styrene-vinylchloride copolymer, a styrene-vinylacetate copolymer, a styrene-maleate copolymer, a styrene-esteracrylate copolymer (a styrene-methylacrylate copolymer, a styrene-ethylacrylate copolymer, a styrene-butylacrylate copolymer, a styrene-octylacrylate copolymer and a styrene-phenylacrylate copolymer), a styrene-ester-methacrylate copolymer (a styrene-methylmethacrylate copolymer, a styrene-ethylmethacrylate copolymer and a styrene-phenylmethacrylate copolymer), a styrene-α-methylchloroacrylate copolymer and a styrene-acrylonitrile-ester-acrylate copolymer; a methylmethacrylate resin; a butyl methacrylate resin; an ethyl acrylate resin; a butyl acrylate resin; a modified acrylic resin such as a silicone-modified acrylic resin, a vinylchloride resin-modified acrylic resin and an acrylic urethane resin; a vinylchloride resin; a styrene-vinylacetate copolymer; a vinylchloride-vinyl-acetate copolymer; a rosin-modified maleic acid resin; a phenol resin; an epoxy resin; a polyester resin; a polyester polyurethane resin; polyethylene; polypropylene; polybutadiene; polyvinylidenechloride; an ionomer resin; a polyurethane resin; a silicone resin; a ketone resin; an ethylene-ethylacrylate copolymer; a xylene resin; a polyvinylbutyral resin; a polyamide resin; a modified-polyphenyleneoxide resin, etc. These can be used alone or in combination.

Specific examples of the elastic rubber and elastomer include, for example, a butyl rubber, a fluorinated rubber, an acrylic rubber, EPDM, NBR, an acrylonitrile-butadiene-styrene natural rubber, an isoprene rubber, a styrene-butadiene rubber, a butadiene rubber, an ethylene-propylene rubber, an ethylene-propylene terpolymer, a chloroprene rubber, chlolosulfonated polyethylene, chlorinated polyethylene, a urethane rubber, syndiotactic 1,2-polybutadiene, an epichlorohydrin rubber, a silicone rubber, a fluorine rubber, a polysulfide rubber, a polynorbomene rubber, a hydrogenated nitrile rubber; and a thermoplastic elastomer such as a polystyrene elastomer, a polyolefin elastomer, a polyvinylchloride elastomer, a polyurethane elastomer, a polyamide elastomer, a polyurea elastomer, a polyester elastomer and a fluorocarbon resin elastomer; etc. These can be used alone or in combination.

Specific examples of a conductant controlling resistivity include, for example, a metallic powder such as carbon black, graphite, aluminium and nickel; and an electroconductive metal oxide such as a tin oxide, a titanium oxide, a antimony oxide, an indium oxide, kalium titanate, an antimony oxide-tin oxide complex oxide and an indium oxide-tin oxide complex oxide. The electroconductive metal oxide may be coated with an insulative particulate material such as barium sulfate, magnesium silicate and calcium carbonate. These are not limited thereto.

A surface layer material of elastic material does not contaminate the photoreceptor and decrease surface friction of a transfer belt to increase cleanability and second transferability of a toner. For example, one, or two or more of a polyurethane resin, a polyester resin and an epoxy resin can reduce a surface energy and increase lubricity. A powder or a particulate material of one, two, or more of a fluorocarbon resin, a fluorine compound, fluorocarbon, a titanium dioxide, silicon carbide can be also used. A material having a surface layer including many fluorine atoms when heated, and having a small surface energy such as a fluorinated rubber can also be used.

The belt can be prepared by the following methods, but the methods are not limited thereto and the belt is typically prepared by combinations of the following plural methods:

(1) a centrifugal forming method of feeding materials into a rotating cylindrical mold;

(2) a spray coating method of spraying a liquid coating to form a film;

(3) a dipping method of dipping a cylindrical mold in a material solution;

(4) a casting method of casting materials into an inner mold and an outer mold; and (5) a method of winding a compound around a cylindrical mold to perform a vulcanizing grind.

As a method of preventing an elongation of the elastic belt, a method of forming a rubber layer on a resin layer having a hard center with less elongation and a method of including an elongation inhibitor in a layer having a hard center are used. However, these are not limited thereto.

Specific examples of the elongation inhibitor include, for example, a natural fiber such as cotton and silk; a synthetic fiber such as a polyester fiber, a nylon fiber, an acrylic fiber, a polyolefin fiber, a polyvinylalcohol fiber, a polyvinylchloride fiber, a polyvinylidenechloride fiber, a polyurethane fiber, a polyacetal fiber, a polyfluoroethylene fiber and a phenol fiber; an inorganic fiber such as a carbon fiber, a glass fiber and a boron fiber; and a metallic fiber such as an iron fiber and a copper fiber. These can be used alone or in combination in the form of a fabric or a filament.

Specific examples of a method of preparing a layer having a hard center include a method of covering a cylindrically-woven fabric over a metallic mold and forming a coated layer thereon; dipping a cylindrically-woven fabric in a liquid rubber and forming a coated layer on one side or both sides thereof; and a method of spirally winding a thread around a metallic mold and forming a coated layer thereon.

When the elastic layer is too thick, expansion and contraction of the surface becomes large and tends to cause cracking, although depending on a hardness thereof. When the expansion and contraction of the surface becomes large, the resultant image largely expands and contracts. Therefore, it is not preferable that the elastic layer is too thick, but preferably has a thickness not less than 1 mm.

The recording medium is not particularly limited, and can be selected from known recording media, e.g., typically a plain paper and even a PET film for OHP.

The visible image transferred onto the recording medium is fixed thereon by a fixer. Each color toner image or the resultant complex full-color image may be fixed thereon.

The fixer is not particularly limited, can be selected in accordance with the purpose, and known heating and pressurizing means are preferably used. The heating and pressurizing means can include a combination of a heating roller and a pressure roller, and a combination of a heating roller, a pressure roller and an endless belt, etc.

The heating temperature is preferably from 80 to 200° C.

In an embodiment of the present invention, a known optical fixer may be used with or instead of the fixer in accordance with the purpose.

The electrostatic latent image bearer is discharged by the discharger upon application of discharge bias.

The discharger is not particularly limited, and can be selected from known dischargers, provided that the discharger can apply the discharge bias to the electrostatic latent image bearer, such as a discharge lamp.

The toner remaining on the electrostatic latent image bearer is preferably removed by the cleaner.

The cleaner is not particularly limited, and can be selected from known cleaners, provided that the cleaner can remove the toner remaining thereon, such as a magnetic brush cleaner, an electrostatic brush cleaner, a magnetic roller cleaner, a blade cleaner, a brush cleaner and a web cleaner.

The image forming apparatus of an embodiment of the present invention preferably has a lubricant applicator applying a lubricant to the surface of an electrostatic latent image bearer. The lubricant is a member selected from the group consisting of metallic soaps, zinc stearate, aluminum stearate and calcium stearate.

The toner removed by the cleaner is recycled into the image developer with a recycler.

The recycler is not particularly limited, and known transporters can be used.

The controller is not particularly limited, and can be selected in accordance with the purpose, provided the controller can control the above-mentioned means, such as a sequencer and a computer.

Figure 6:
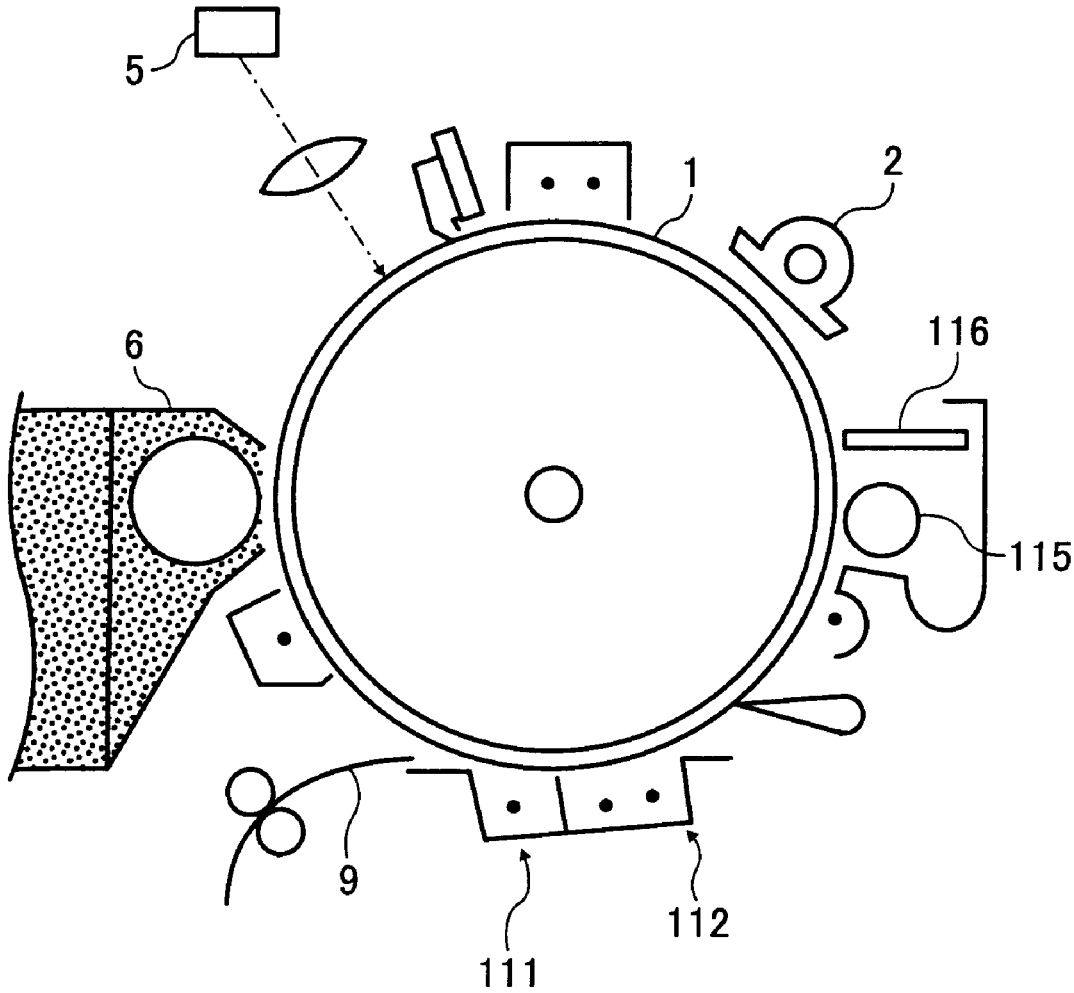
FIG. 6 is a schematic view illustrating a partial cross-section of an embodiment of the image forming apparatus of the present invention.

FIG. 6 is a schematic view illustrating a partial cross-section of an embodiment of the image forming apparatus of the present invention.

A photoreceptor 1 has the shape of a drum, and may have the shape of a sheet or an endless belt. Known chargers such as a corotron, a scorotron, a solid state charger and a charging roller contacting the photoreceptor or being located close thereto with a gap tape or a step can be used.

The charging roller located close to a photoreceptor is less unevenly or poorly charged than the charging roller contacting the photoreceptor, and is free from maintenance. However, a high voltage has to be applied thereto, i.e., a large stress is applied to the surface thereof, resulting in noticeable abrasion of an outermost layer (a CTL or a protection layer) including a conventional polymer binder. Further, a DC voltage overlapped with an AC voltage is preferably applied to the charging roller located close to a photoreceptor because of unstably discharging with only a DC voltage, which causes uneven image density.

The electrophotographic photoreceptor of the present invention is scarcely abraded with the charging roller and stably charged, and stably produces quality images even when repeatedly used for long periods because of reducing the residual potential of the irradiated parts and preventing production of blurred images.

The transferer includes the above-mentioned charges, and a combination of the transfer charger 111 and the separation charger 112 as illustrated in FIG. 6 is preferably used.

Specific examples of light sources for use in an irradiator 5 and a discharge lamp 2 include general light-emitting materials such as fluorescent lamps, tungsten lamps, halogen lamps, mercury lamps, sodium lamps, LEDs, LDs, light sources using electroluminescence (EL), etc. In addition, in order to obtain light having a desired wave length range, filters such as sharp-cut filters, band pass filters, near-infrared cutting filters, dichroic filters, interference filters, color temperature converting filters, etc. can be used.

The above-mentioned light sources can be used for not only the process illustrated in FIG. 6, but also other processes such as a transfer process, a discharging process, a cleaning process, a pre-exposure process including light irradiation to the photoreceptor.

When a toner image formed on the photoreceptor 1 by a developing unit 6 is transferred onto a transfer sheet 9, all of the toner image is not transferred thereto, and a residual toner remains on the surface of the photoreceptor 10. The residual toner is removed therefrom by a cleaning brush 115, a cleaning blade 116 or their combination. Specific examples of the cleaning brush include known cleaning brushes such as a fur brush and a mag-fur brush.

Specific examples of the cleaning blade 116 include elastic bodies having a low friction coefficient, such as a urethane resin, a silicone resin, a fluorine-containing resin, a urethane elastomer, a silicone elastomer and a fluorine-containing elastomer. A heat-hardening urethane resin is preferably used, and the urethane elastomer is more preferably used in terms of abrasion resistance, ozone resistance and contamination resistance. The elastomer includes a rubber. The cleaning blade 116 preferably has a hardness of 65 to 85°, specified in JIS-A, a thickness of 0.8 to 3.0 mm and an extrusion of 3 to 15 mm. Other conditions such as contact pressure, contact angle and bury can be determined as desired.

The cleaning blade removes the toner well, however, it gives mechanical stress to the surface of the photoreceptor, resulting in abrasion thereof. The electrophotographic photoreceptor of an embodiment of the present invention stably produces quality images even when used in an image forming apparatus using the cleaning blade because the protection layer thereof has high abrasion resistance.

The image forming apparatus of the present invention may include a lubricant applicator. A spherical toner advantageously used to produce high-quality images is known to be difficult to clean with a blade. Therefore, the contact pressure is increased or a urethane rubber blade having high hardness is used. These give a large stress to the surface of a photoreceptor. Although the electrophotographic photoreceptor of the present invention is scarcely abraded even with such blades, the blade vibrates or an edge thereof is abraded.

The lubricant applicator in the image forming apparatus of an embodiment of the present invention applies a lubricant to the surface of a photoreceptor to reduce the friction coefficient thereof against the cleaning blade for long periods.

Figure 7:
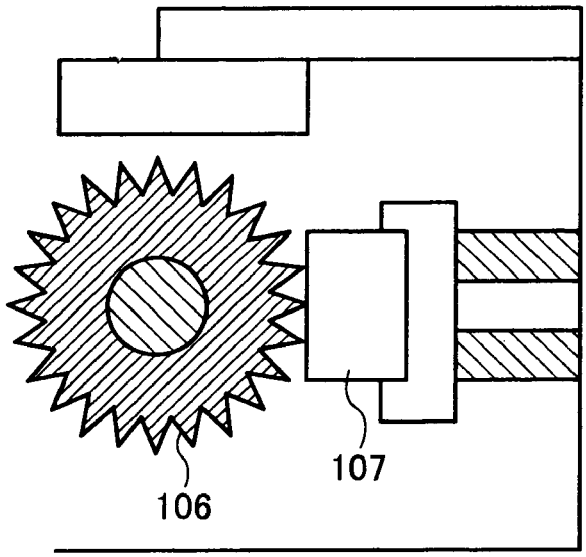
FIG. 7 is a schematic view illustrating an embodiment of a lubricant applicator for use in the image forming apparatus of the present invention.

In FIG. 7, a solid lubricant 107 in the shape of a stick is pressed against a cleaning brush 106. When the cleaning brush 106 rotates, the cleaning brush scrapes the lubricant and applies the lubricant to the surface of a photoreceptor. The lubricant need not be a solid, may be a liquid, a powder or a paste provided that the lubricant can be applied to the surface thereof and satisfies the electrophotographic properties. Specific examples of the lubricant include metallic soaps such as zinc stearate, valium stearate, aluminum stearate and calcium stearate; waxes such as carnauba, lanolin and a haze wax; and lubricative oils such as a silicone oil, etc. The zinc stearate, aluminum stearate and calcium stearate are preferably used because of being easily formed into a stick and having high lubricating ability.

When the lubricant applicator is installed in a cleaning unit, although the apparatus and the layout therein can be simplified, the toner becomes difficult to recycle because the lubricant is mixed in the toner collected in a large amount and the cleanability of the brush deteriorates. In order to solve this problem, an applicator unit having a lubricant applicator may separately be installed from a cleaning unit. In that case, the applicator unit is preferably located downstream of the cleaning unit. Further, plural applicator units working at the same time or sequentially can increase the application efficiency of the lubricant and control the consumption thereof.

Figure 8:
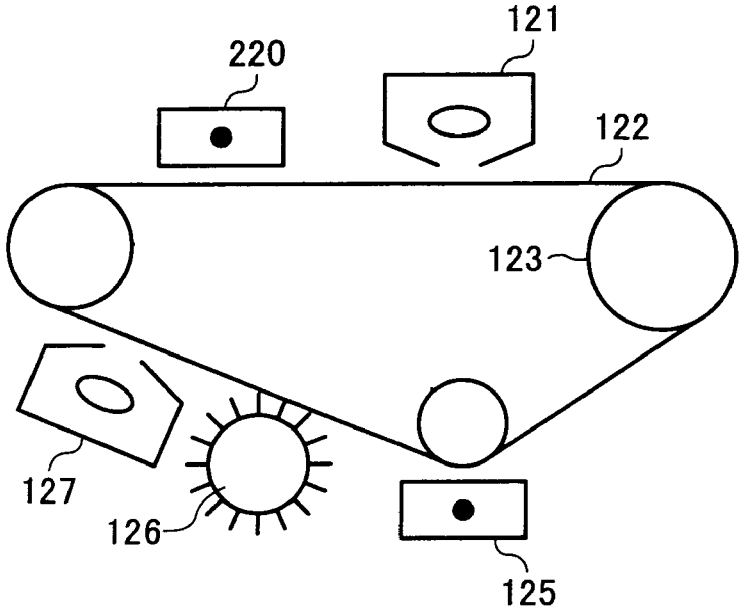
FIG. 8 is a schematic view illustrating a partial cross-section of another embodiment of the image forming apparatus of the present invention.

FIG. 8 is a schematic view illustrating a partial cross-section of another embodiment of the image forming apparatus of the present invention.

In FIG. 8, a photoreceptor 122 is the electrostatic latent image bearer of an embodiment of the present invention, and is driven by a drive roller 123. Charging using a charger 220, imagewise exposure using an imagewise light irradiator 121, developing using a developing unit (not shown), transferring using a transfer charger 125, cleaning using a cleaning brush 126 and discharging using a discharging light source 127 are repeatedly performed.

Figure 9:
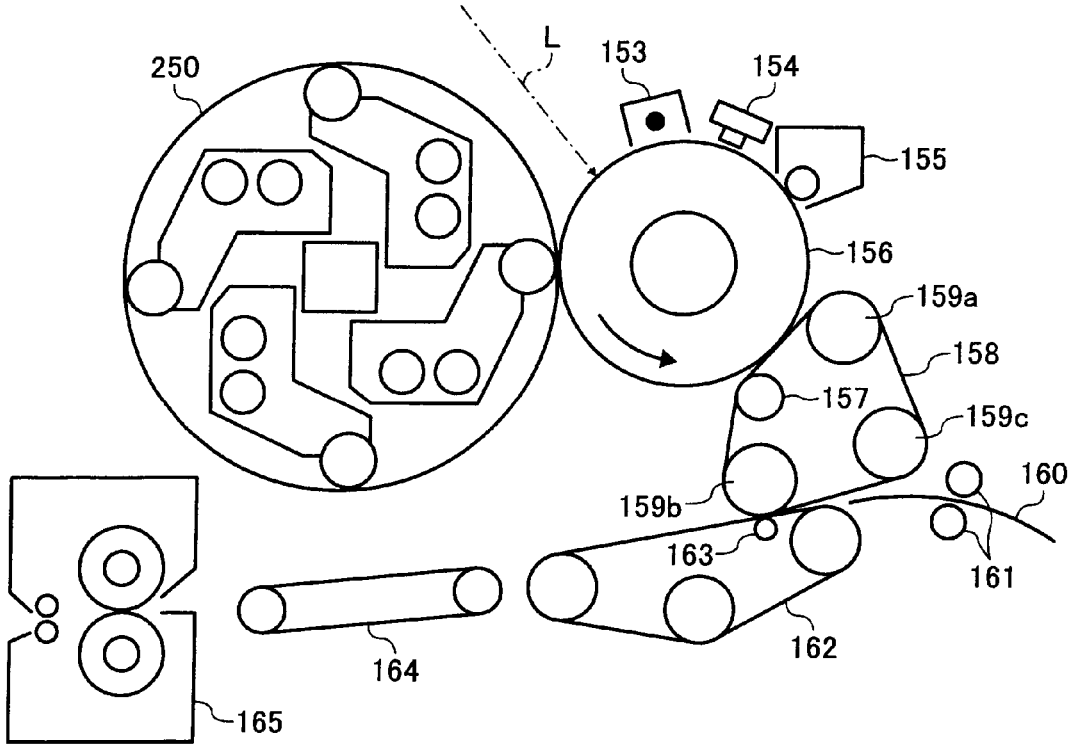
FIG. 9 is a schematic view illustrating a partial cross-section of a further embodiment of the image forming apparatus of the present invention.

FIG. 9 is a schematic view illustrating a partial cross-section of a further embodiment of the image forming apparatus of the present invention.

In FIG. 9, after a surface of a photoreceptor 156 as an image bearer is uniformly charged by a charger 153 using a corotron or a scorotron while rotated counterclockwise, the photoreceptor is scanned by a laser beam (L) emitted from a laser optical device (not shown) to bear an electrostatic latent image. Since the photoreceptor is scanned based on image information of each single color, i.e., yellow, magenta, cyan and black decomposed from a full-color image, an electrostatic latent image having a single color, i.e., yellow, magenta, cyan or black is formed on the photoreceptor 156. A revolver developing unit 250 is located on the left side of the photoreceptor 156. The revolver developing unit 250 has a yellow image developer, a magenta image developer, a cyan image developer and a black image developer in its rotating drum-shaped chassis, and rotates to sequentially locate each image developer in a developing position facing the photoreceptor 156. The yellow image developer, magenta image developer, cyan image developer and black image developer develop an electrostatic latent image by adhering a yellow toner, a magenta toner, a cyan toner and a black toner respectively thereto. An electrostatic latent image having each color is sequentially formed on the photoreceptor 156, and is sequentially developed by each image developer of the revolver developing unit 250 to form a yellow toner image, a magenta toner image, a cyan toner image and a black toner image.

An intermediate transfer unit is located in the downstream of rotation direction of the photoreceptor 156 from the developing position. The intermediate transfer unit endlessly rotates an intermediate transfer belt 158 stretched by a stretch roller 159*a*, an intermediate transfer bias roller 157 as a transferer, a second-transfer backup roller 159*b* and a belt drive roller 159*c* clockwise with a rotary drive thereof. The yellow toner image, magenta toner image, cyan toner image and black toner image are transferred to an intermediate transfer nip where the photoreceptor 156 and the intermediate transfer belt 158 contact each other. Then, the yellow toner image, magenta toner image, cyan toner image and black toner image are transferred onto the intermediate transfer belt 158 while affected by a bias from the intermediate transfer bias roller 157, and overlapped thereon to form a four-color overlapped toner image. The intermediate transfer method of overlapping toner images is an effective method for forming high-quality full color images because relative positions between the photoreceptor and the intermediate transferer can easily and precisely be fixed to prevent color drift.

A residual toner after transfer on a surface of the photoreceptor 156 which passed the intermediate transfer nip in accordance with the rotation is cleaned by a cleaning unit 155. The cleaning unit 155 cleans the residual toner after transfer with a cleaning roller a cleaning bias is applied to. However, the cleaning unit 155 may use a cleaning brush such as a fur brush and a mag-fur brush or a cleaning blade.

The surface of the photoreceptor 156, the residual toner on which after transfer is cleaned, is discharged by a discharging lamp 154. Fluorescent lamps, tungsten lamps, halogen lamps, mercury lamps, sodium lamps, light emitting diodes (LEDs), laser diodes (LDs), light sources using electroluminescence (EL) and the like are used for the discharging lamp 154. Filters such as sharp-cut filters, band pass filters, near-infrared cutting filters, dichroic filters, interference filters, color temperature converting filters and the like can be used to obtain light having a desired wavelength range.

Below the intermediate transfer unit in FIG. 9, a transfer unit including a transfer belt and various rollers such as a transfer bias roller and drive roller is located. On the left side of FIG. 8, a paper transfer belt 164 and a fixing unit 165 are located. The endless transfer belt may move up and down, and transports to a position not to contact the intermediate transfer belt 158 at least when a single-color (yellow) toner image, or a two or three-color toner image on the intermediate transfer belt 158 passes an opposite position to a paper transfer bias roller 163. Before an end of four-color toner image on the intermediate transfer belt 158 enters the opposite position to a paper transfer bias roller 163, the transfer unit moves to a position to contact the intermediate transfer belt 158 and forms a second transfer nip.

On the other hand, a resist roller 161 sandwiching a transfer paper 160 fed from a paper feeding cassette (not shown) between two rollers feeds the transfer paper 160 to the second transfer nip in time for overlapping the transfer paper 160 on the four-color overlapped toner image on the intermediate transfer belt 158. The four-color overlapped toner image on the intermediate transfer belt 158 is secondly transferred onto the transfer paper 160 at a time in the second transfer nip with a second transfer bias from a paper transfer bias roller 163. This second transfer forms a full-color image on the transfer paper 160. The transfer paper 160 a full-color image is formed on is fed to the paper transfer belt 164 by a transfer belt 162. The paper transfer belt 164 feeds the transfer paper 160 from the transfer unit to a fixer 165.

The fixer 165 transfers the transfer paper 160 while passing the transfer paper 160 through a fixing nip formed of a contact between a heating roller and a backup roller. The full-color image on the transfer paper 160 is fixed thereon with a heat from the heating roller and a pressure in the fixing nip.

A bias is applied to the transfer belt 162 and paper transfer belt 164 to draw the transfer paper 160 thereon, although not shown. A paper discharger discharging the transfer paper 160, and three dischargers discharging each belt, i.e., the intermediate transfer belt 158, transfer belt 162 and paper transfer belt 164 are arranged. The intermediate transfer unit is also equipped with a belt cleaning unit similar to the drum cleaning unit 155, which cleans a residual toner on the intermediate transfer belt 158 after transfer.

Figure 10:
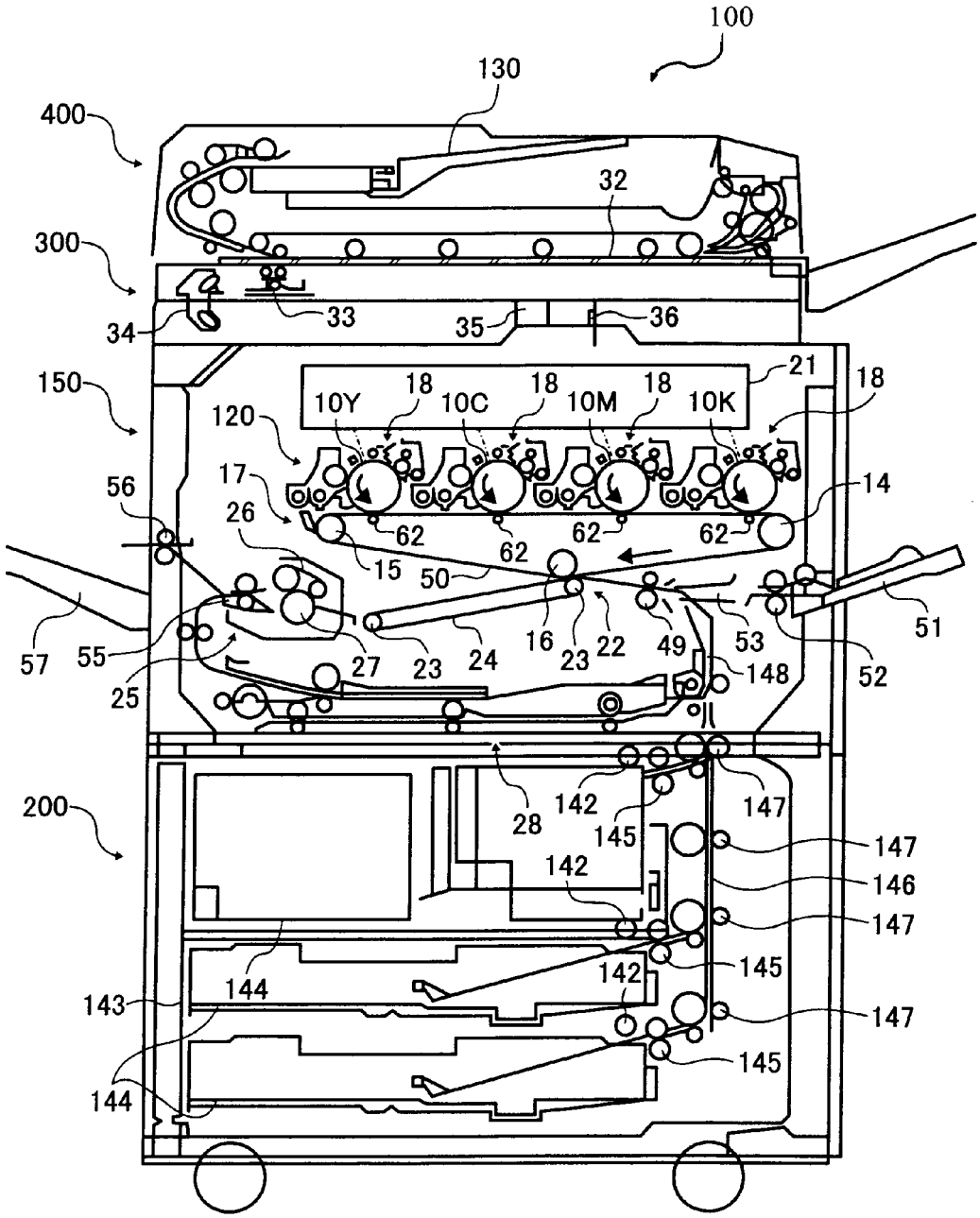
FIG. 10 is a schematic view illustrating a whole cross-section of an embodiment of a tandem full-color image forming apparatus for explaining the image forming method of the present invention.

FIG. 10 is a schematic view illustrating a whole cross-section of an embodiment of a tandem full-color image forming apparatus for explaining the image forming method of the present invention.

The tandem image forming apparatus 100 includes a duplicator 150, a paper feeding table 200, a scanner 300 and an automatic document feeder (ADF) 400.

The duplicator 150 includes an intermediate transferer 50 having the shape of an endless belt. The intermediate transferer 50 is suspended by three suspension rollers 14, 15 and 16 and rotatable in a clockwise direction. On the left of the suspension roller 15, an intermediate transferer cleaner 17 is located to remove a residual toner on an intermediate transferer 50 after an image is transferred. Above the intermediate transferer 50, four image forming units 18 for yellow, cyan, magenta and black colors are located in line from left to right along a transport direction of the intermediate transferer 50 to form a tandem image forming developer 120. Above the tandem color image developer 120, an irradiator 21 is located. On the opposite side of the tandem color image developer 120 across the intermediate transferer 50, a second transferer 22 is located. The second transferer 22 includes a an endless second transfer belt 24 and two rollers 23 suspending the endless second transfer belt 24, and is pressed against the suspension roller 16 across the intermediate transferer 50 and transfers an image thereon onto a sheet. Beside the second transferer 22, a fixer 25 fixing a transferred image on the sheet is located. The fixer 25 includes an endless belt 26 and a pressure roller 27 pressed against the belt. Below the second transferer 22 and the fixer 25, a sheet reverser 28 reversing the sheet to form an image on both sides thereof is located in the tandem color image forming apparatus 100.

Next, full-color image formation using a tandem image developer 120 will be explained. An original is set on a table 130 of the ADF 400 to make a copy, or on a contact glass 32 of the scanner 300 and pressed with the ADF 400.

When a start switch (not shown) is turned on, a first scanner 33 and a second scanner 34 scans the original after the original set on the table 30 of the ADF 400 is fed onto the contact glass 32 of the scanner 300, or immediately when the original set thereon. The first scanner 33 emits light to the original and reflects reflected light therefrom to the second scanner 34. The second scanner further reflects the reflected light to a reading sensor 36 through an imaging lens 35 to read the color original (color image) as image information of black, yellow, magenta and cyan.

Figure 11:
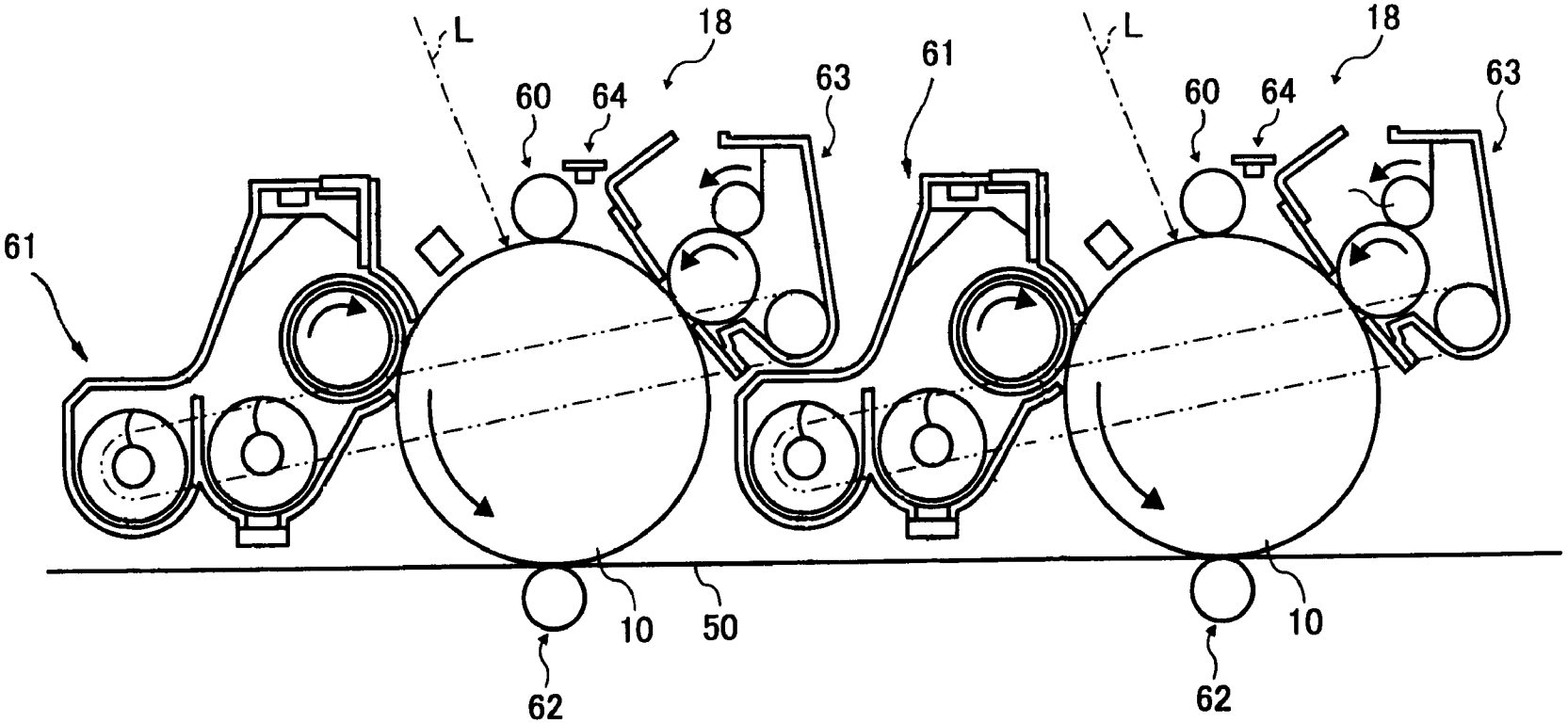
FIG. 11 is a schematic amplified view illustrating a part of the image forming apparatus in FIG. 10.

The black, yellow, magenta and cyan image information are transmitted to each image forming units 18, i.e., a black image forming unit, a yellow image forming unit, a magenta image forming unit and a cyan image forming unit in the tandem image developer 120 respectively, and the respective image forming units form a black toner image, a yellow toner image, a magenta toner image and a cyan toner image. Namely, each of the image forming units 18 in the tandem image developer 120 includes, as shown in FIG. 11, a photoreceptor 10, i.e., a photoreceptor for black 10K, a photoreceptor for yellow 10Y, a photoreceptor for magenta 10M and a photoreceptor for cyan 10C; a charger 60 uniformly charging the photoreceptor; an irradiator irradiating the photoreceptor with imagewise light (L in FIG. 11) based on each color image information to form an electrostatic latent image thereon; an image developer 61 developing the electrostatic latent image with each color toner, i.e., a black toner, a yellow toner, a magenta toner and a cyan toner to form a toner image thereon; a transfer charger 62 transferring the toner image onto an intermediate transferer 50; a photoreceptor cleaner 63; and a discharger 64. When a start switch (not shown) is turned on, a drive motor (not shown) rotates one of the suspension rollers 14, 15 and 16 such that the other two rollers are driven to rotate, to rotate the intermediate transferer 50. At the same time, each of the image forming units 18 rotates a photoreceptor 10 and forms a single-colored image, i.e., a black image (K), a yellow image (Y), a magenta image (M) and cyan image (C) on each photoreceptor 10K, 10Y, 10M and 10C. The single-colored images are sequentially transferred (first transfer) onto the intermediate transferer 50 to form a full-color image thereon.

On the other hand, when start switch (not shown) is turned on, one of paper feeding rollers 142 of paper feeding table 200 is selectively rotated to take a sheet out of one of multiple-stage paper cassettes 144 in a paper bank 143. A separation roller 145 separates sheets one by one and feed the sheet into a paper feeding route 146, and a feeding roller 147 feeds the sheet into a paper feeding route 148 to be stopped against a resist roller 49. Alternatively, a paper feeding roller 150 is rotated to take a sheet out of a manual feeding tray 51, and a separation roller 52 separates sheets one by one and feeds the sheet into a paper feeding route 53 to be stopped against the resist roller 49. The resist roller 49 is typically grounded, and may be biased to remove paper dust from the sheet.

Then, in timing with a synthesized full-color image on the intermediate transferer 50, the resist roller 49 is rotated to feed the sheet between the intermediate transferer 50 and the second transferer 22, and the second transferer transfers (second transfer) the full-color image onto the sheet. The intermediate transferer 50 after transferring an image is cleaned by the intermediate transferer cleaner 17 to remove a residual toner thereon after the image is transferred.

The sheet the full-color image is transferred on is fed by the second transferer 22 to the fixer 25. The fixer 25 fixes the image thereon upon application of heat and pressure, and the sheet is discharged by a discharge roller 56 onto a catch tray 57 through a switch-over click 55. Alternatively, the switch-over click 55 feeds the sheet into the sheet reverser 28 reversing the sheet to a transfer position again to form an image on the backside of the sheet, and then the sheet is discharged by the discharge roller 56 onto the catch tray 57.

The tandem method can produce images much faster than the revolver method because each color is developed in parallel. The printer in FIG. 10 uses an intermediate transfer method, and can stably and repeatedly produce high-quality full color images with less color drift at a very high speed for long periods when using the electrophotographic photoreceptor of the present invention.

The process cartridge of the present invention includes at least an electrostatic latent image bearer bearing an electrostatic latent image and an image developer developing the electrostatic latent image with a developer to form a visible image, and optional other means.

The image developer includes at least a developer container containing the toner or developer of the present invention and a developer bearer bearing the toner or developer contained in the container, and may further include a layer thickness regulator regulating a layer thickness of the toner.

Figure 12:
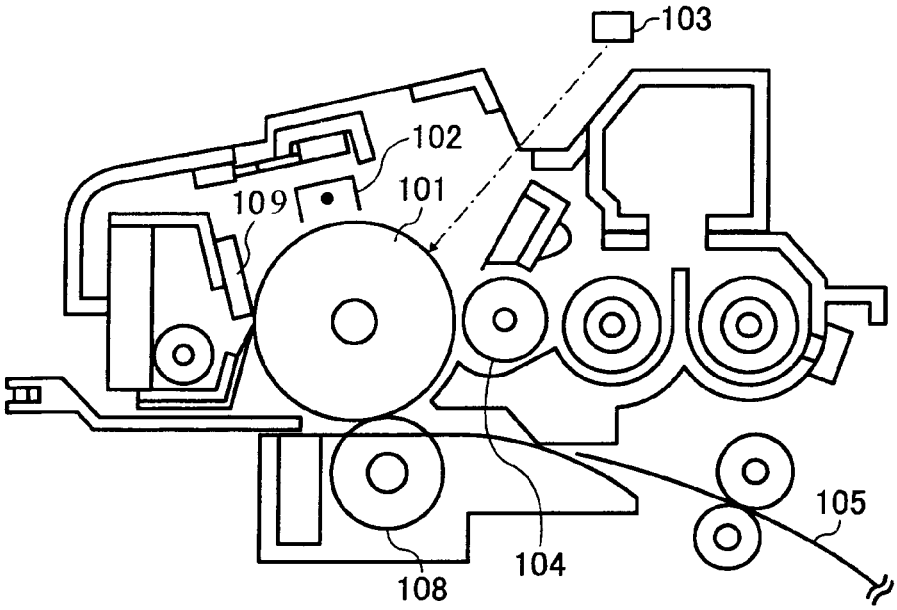
FIG. 12 is a schematic view illustrating a cross-section of an embodiment of the process cartridge of the present invention.
Figure 13:
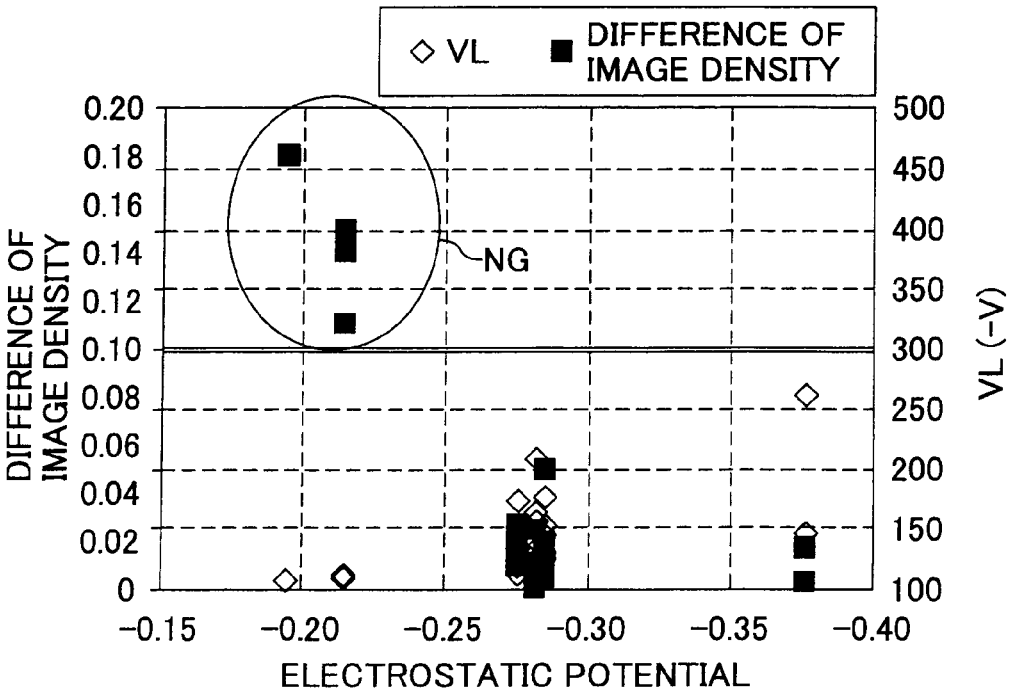
FIG. 13 is a diagram showing relationships among electrostatic potentials, differences of image density and VL (irradiated part potentials) in Examples 1 to 17 and Comparative Examples 1 to 4, wherein the smaller the differences of image density and VL, the better the electrophotographic photoreceptor.
Figure 14:
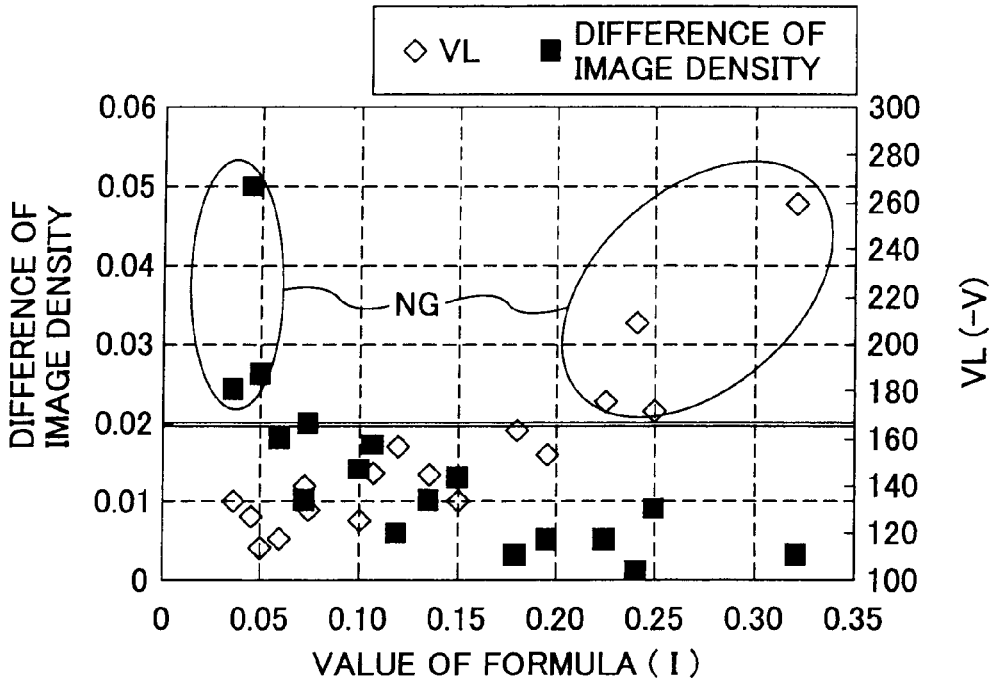
FIG. 14 is a diagram showing relationships among values of −(V−(−0.27))X, differences of image density and VL (irradiated part potentials) in Examples 1 to 17 and Comparative Examples 1 to 4, wherein the smaller the differences of image density and VL, the better the electrophotographic photoreceptor.
Figure 15:
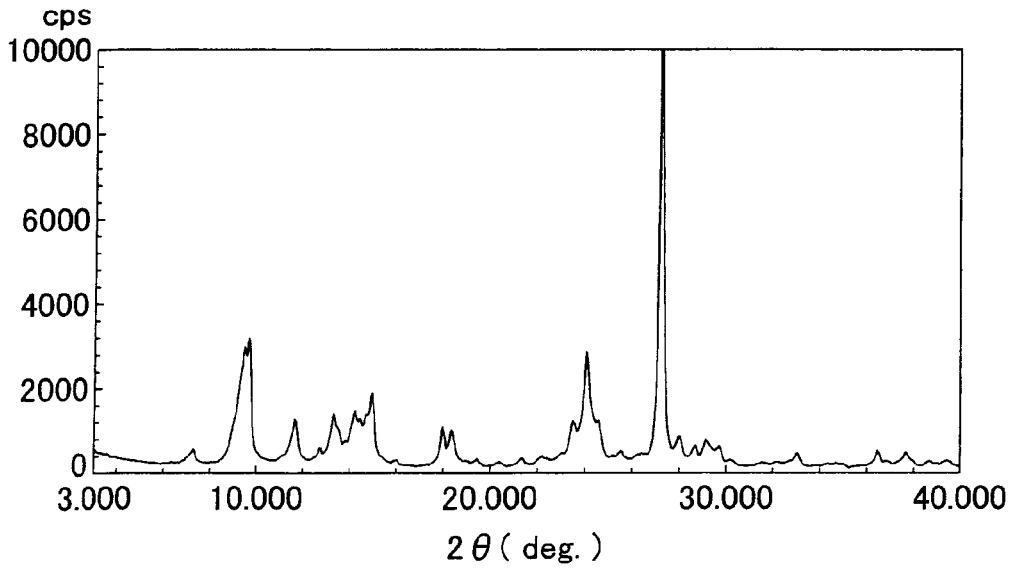
FIG. 15 is a chart showing a XD spectrum of the oxotitaniumphthalocyanine powder for use in the CGL in Examples 18 to 34 and Comparative Examples 1 to 4 of the present invention.
Figure 16:
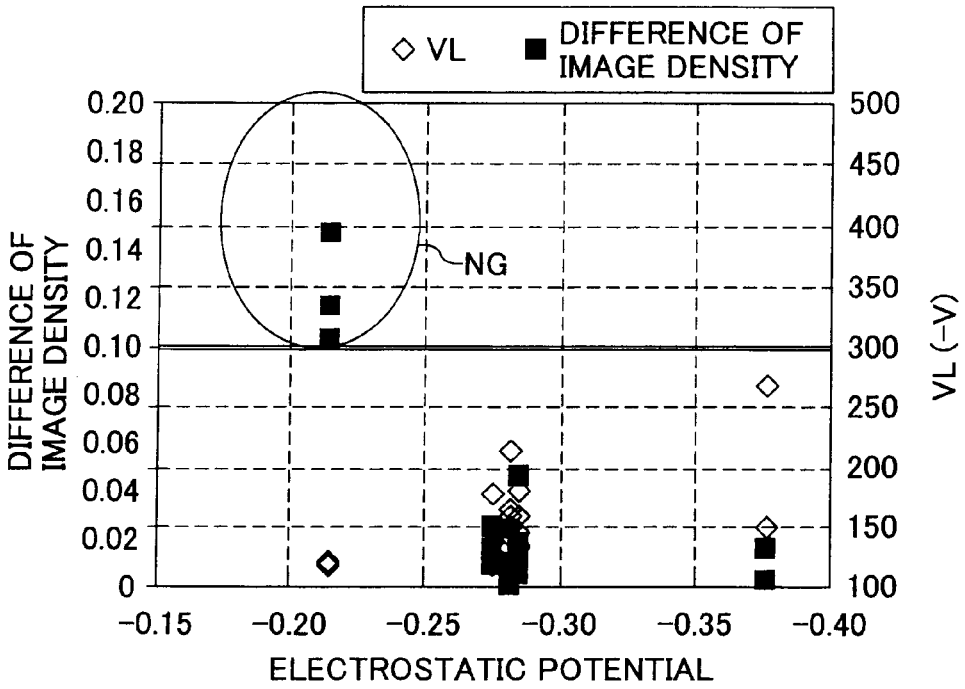
FIG. 16 is a diagram showing relationships among electrostatic potentials, differences of image density and VL (irradiated part potentials) in Examples 18 to 34 and Comparative Examples 7 and 8, wherein the smaller the differences of image density and VL, the better the electrophotographic photoreceptor.
Figure 17:
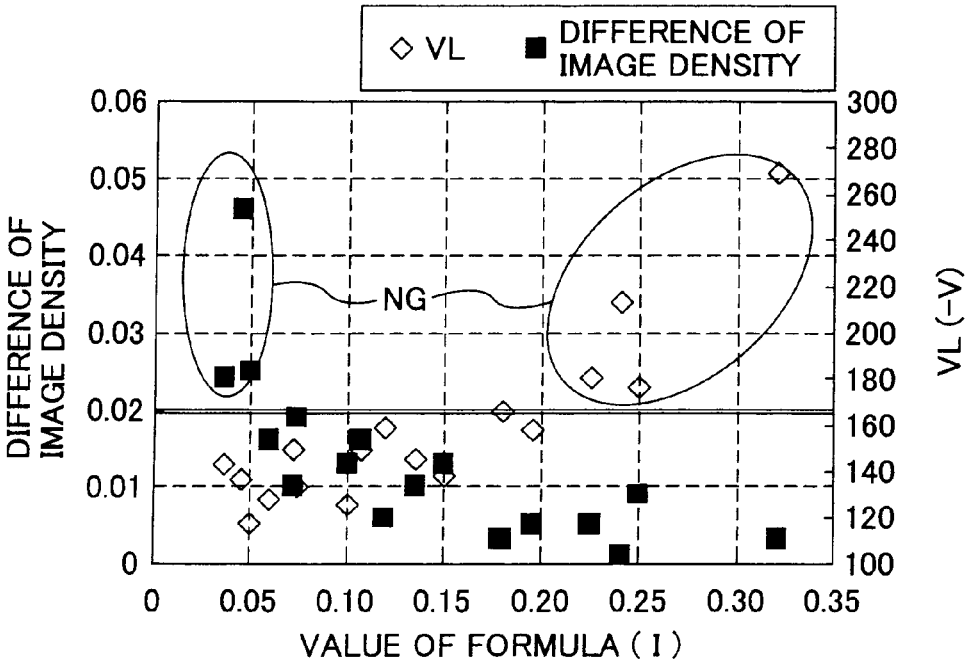
FIG. 17 is a diagram showing relationships among values of −(V−(−0.27))X, differences of image density and VL (irradiated part potentials) in Examples 18 to 34 and Comparative Examples 7 and 8, wherein the smaller the differences of image density and VL, the better the electrophotographic photoreceptor.
Figure 18:
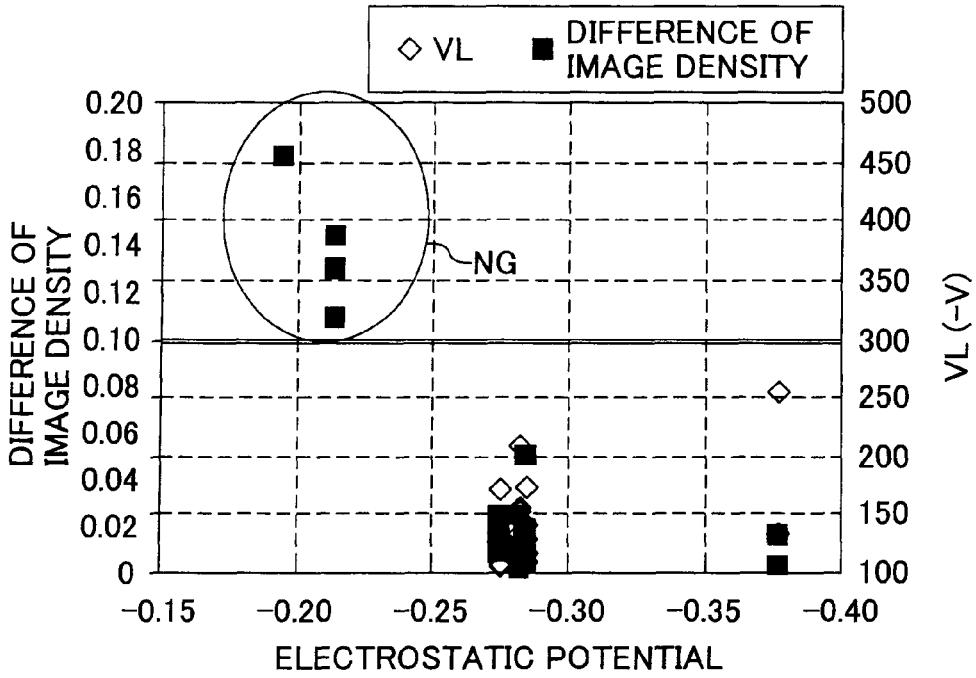
FIG. 18 is a diagram showing relationships among electrostatic potentials, differences of image density and VL (irradiated part potentials) in Examples 35 to 51 and Comparative Examples 9 to 12, wherein the smaller the differences of image density and VL, the better the electrophotographic photoreceptor.
Figure 19:
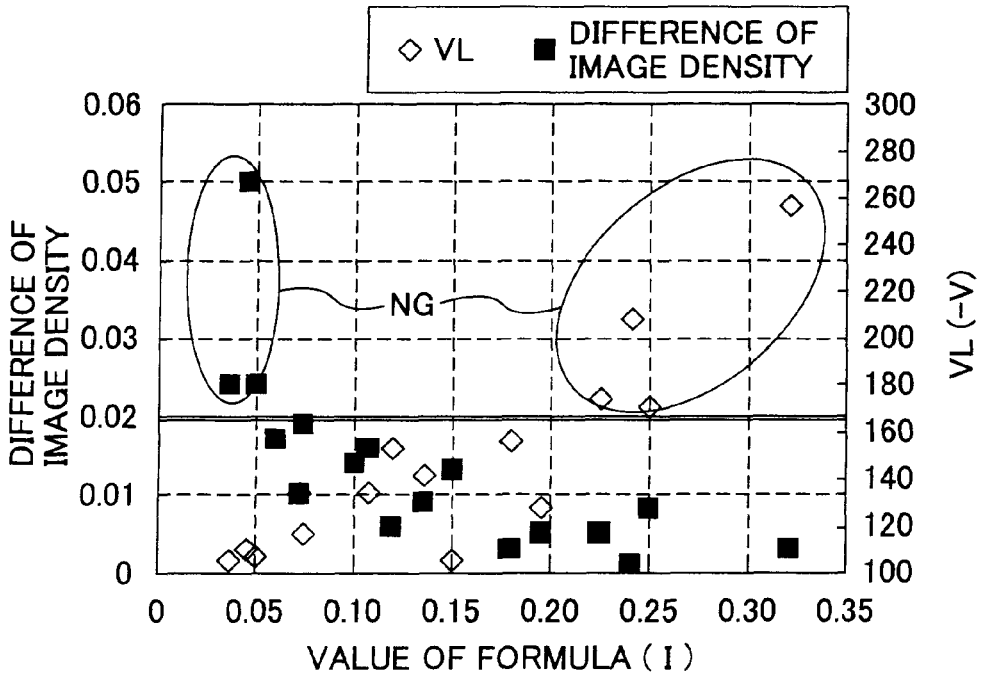
FIG. 19 is a diagram showing relationships among values of −(V−(−0.27))X, differences of image density and VL (irradiated part potentials) in Examples 35 to 51 and Comparative Examples 9 to 12, wherein the smaller the differences of image density and VL, the better the electrophotographic photoreceptor.
Figure 20:
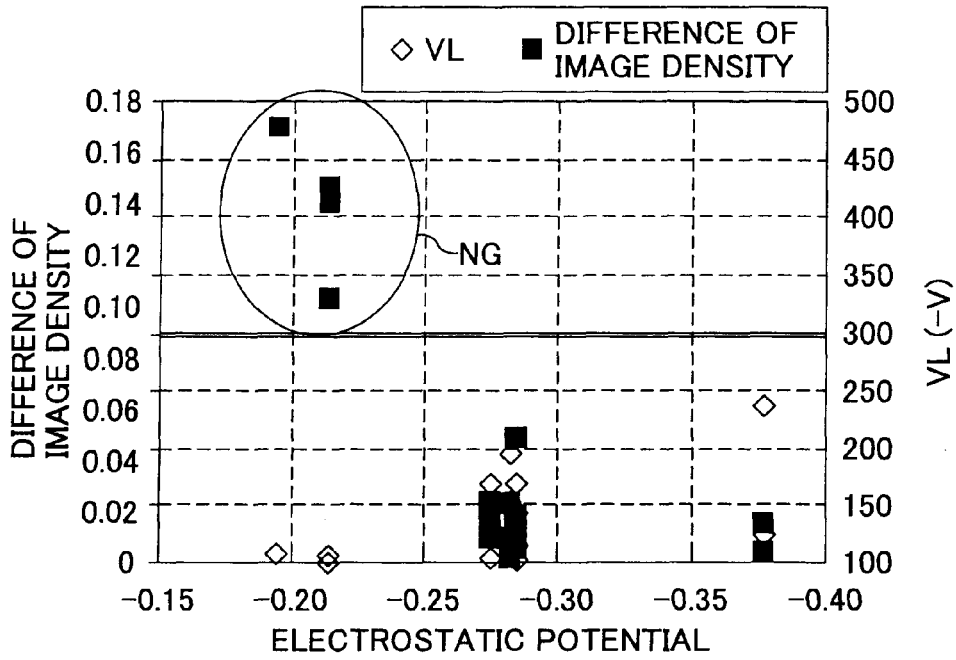
FIG. 20 is a diagram showing relationships among electrostatic potentials, differences of image density and VL (irradiated part potentials) in Examples 52 to 68 and Comparative Examples 13 to 16, wherein the smaller the differences of image density and VL, the better the electrophotographic photoreceptor.
Figure 21:
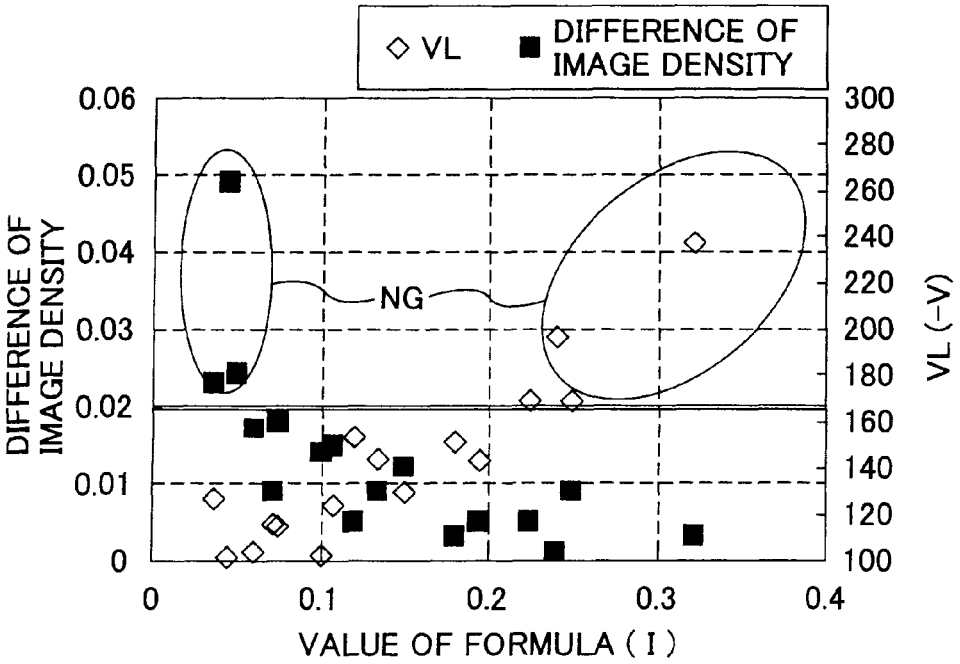
FIG. 21 is a diagram showing relationships among values of −(V−(−0.27))X, differences of image density and VL (irradiated part potentials) in Examples 52 to 68 and Comparative Examples 13 to 16, wherein the smaller the differences of image density and VL, the better the electrophotographic photoreceptor.
Figure 22:
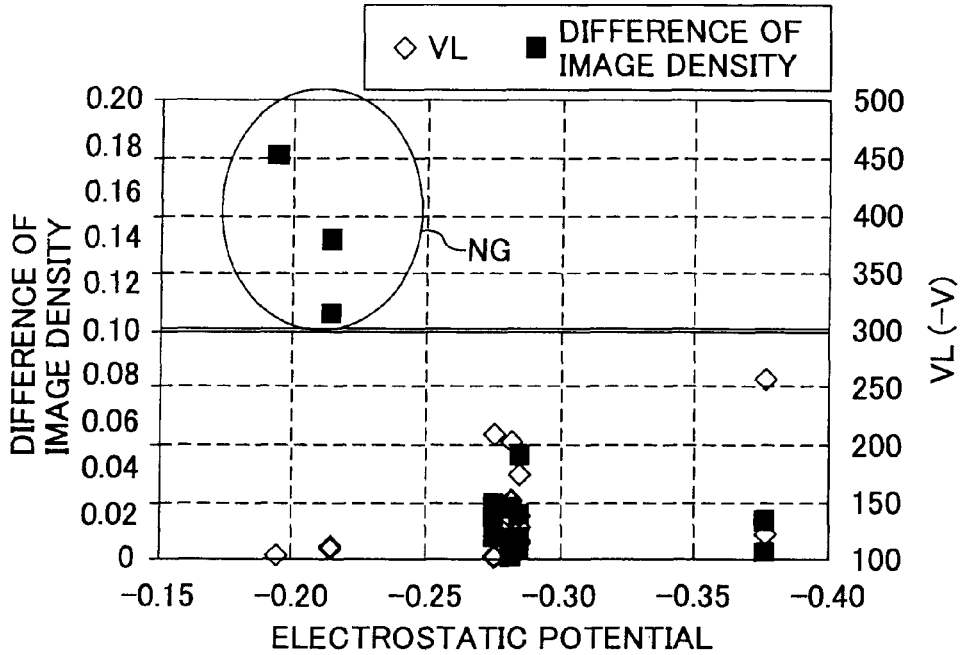
FIG. 22 is a diagram showing relationships among electrostatic potentials, differences of image density and VL (irradiated part potentials) in Examples 69 to 85 and Comparative Examples 17 to 20, wherein the smaller the differences of image density and VL, the better the electrophotographic photoreceptor.
Figure 23:
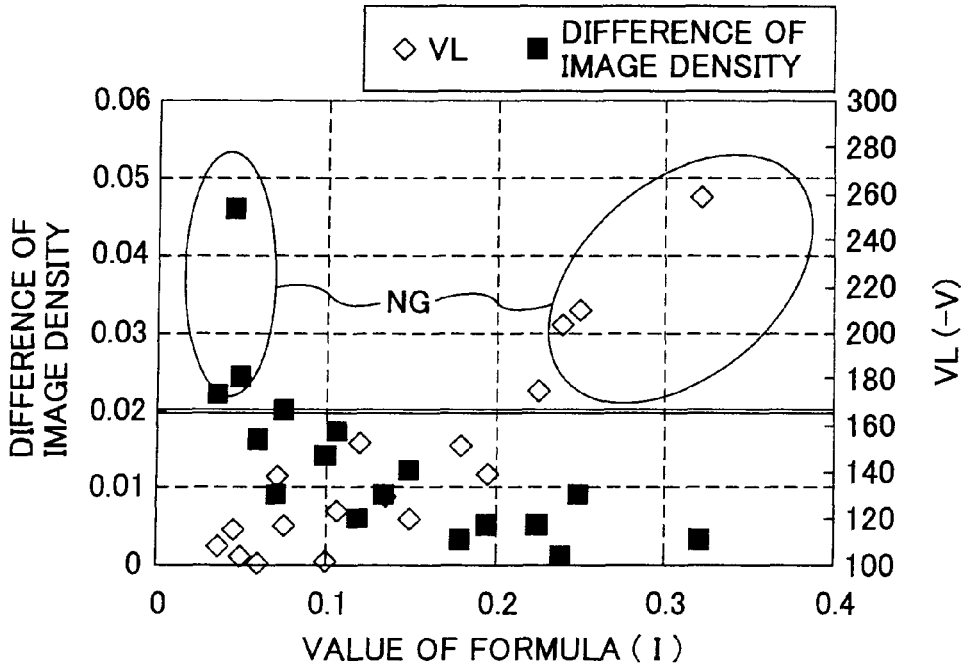
FIG. 23 is a diagram showing relationships among values of −(V−(−0.27))X, differences of image density and VL (irradiated part potentials) in Examples 69 to 85 and Comparative Examples 17 to 20, wherein the smaller the differences of image density and VL, the better the electrophotographic photoreceptor.

The process cartridge includes, as shown in FIG. 12, a photoreceptor 101 and at least one of a charger 102, an irradiator 103, an image developer 104, a cleaner 109 and other means. Numeral 105 is a recording medium and 108 is a transfer roller.

The photoreceptor 101 is the electrophotographic photoreceptor of an embodiment ofthe present invention.

The irradiator 103 uses a light source capable of writing a high-resolution electrostatic latent image.

The charger 102 may be any conventional charger.

The image forming apparatus of an embodiment of the present invention may include the electrostatic latent image bearer and at least one of components such as an image developer and a cleaner as a process cartridge in a body, which is detachable therefrom. Alternatively, a process cartridge including the electrostatic latent image bearer and at least one of a charger, an irradiator, an image developer, a transferer or separator, and a cleaner may be detachable from the image forming apparatus through a guide rail or the like.

Since the electrostatic latent image bearer and other components can easily be replaced in a short time when included in a process cartridge, the maintenance of the image forming apparatus can be performed in a shorter time, which leads to a reduction in cost. In addition, since the electrostatic latent image bearer and other components are in a body, the preciseness of the relative positions thereof is improved.

Having generally explained the present invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Electric potentials of the following electrophotographic photoreceptors 1 to 109 were measured, and image qualities and levels of blurred images produced thereby were evaluated.

| Undercoat layer coating liquid | |
|---|---|
| Titanium dioxide powder | 400 |
| Melamine resin | 65 |
| Alkyd resin | 120 |
| 2-butanone | 400 |

| CGL coating liquid | |
|---|---|
| Fluorenone bisazo pigment having the following formula | 12 |

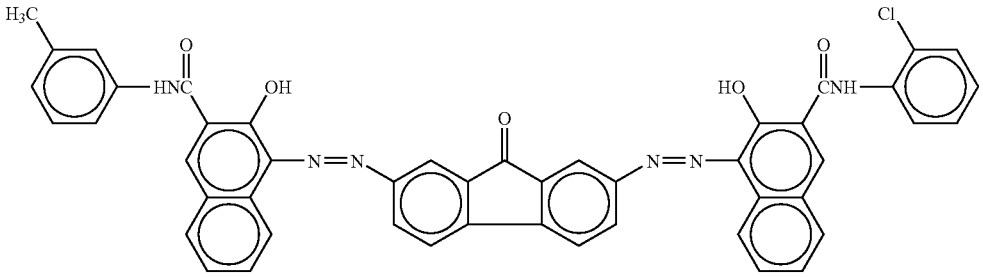

| | |
|---|---|
| Polyvinyl butyral | 5 |
| 2-butanone | 200 |
| Cyclohexanone | 400 |

Image Quality

Each of the photoreceptors was installed in a process cartridge, and the process cartridge was installed in the full-color printer IPSiO CX8100 from Ricoh Company, Ltd., using a roller charger and an irradiator emitting a laser having a wavelength 660 nm such that the photoreceptor had dark space potential of 700 (−V) and an image illuminance of 0.45 μj/cm$^2$. After 50,000 A4 600 dpi images having an image area of 5% were produced thereby, an irradiated part potential (VL) of the photoreceptor was measured by TREK 344, and a level of blurred images was evaluated.

Blurred Image

After each of the photoreceptors partially taped with TEFLON tape was left in a desiccator including an oxidizing gas of 50 ppm for 4 days, the photoreceptor was installed in the full-color printer IPSiO CX8100 from Ricoh Company, Ltd. and a halftone image was produced thereby. A difference of image density between the taped and untaped parts was evaluated as an indication of the blurred image. The image density can be measured by a conventional densitometer.

The VL is preferably not greater than 300 (−V), and more preferably not greater than −170 (−V). The difference of image density is preferably not greater than 0.1, and more preferably 0.02.

Examples 1 to 17

An undercoat coating liquid, a charge generation coating liquid and charge transport coating liquid, which have the following formulations, were coated in this order on an aluminum cylinder by a dip coating method and dried to prepare electrophotographic photoreceptors 1 to 34 having an undercoat layer of 3.5 μm thick, a CGL of 0.2 μm thick, a CTL of 23 μm thick.

| CTL coating liquid | |
|---|---|
| Polycarbonate resin (Z polyca from Teijin Chemicals Ltd.) | 10 |
| The compound having an amine site in Table 1 (No. and parts by weight are shown in Table 2) | |
| CTM having the following formula (10 parts by weight minus parts by weight of the compound having an amine site) | |

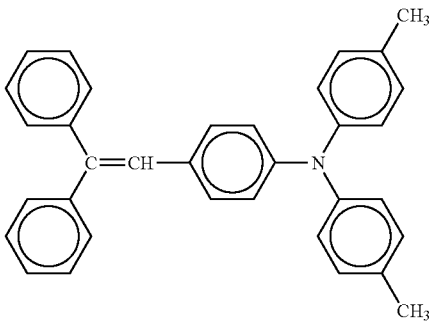

| | |
|---|---|
| Tetrahydrofuran | 100 |

TABLE 2

| | P No. | C No. | EP | ACW | ACC | F(I) | VL(−V) | DID |
|---|---|---|---|---|---|---|---|---|
| Example 1 | 1 | 1 | −0.285 | 1 | 5 | 0.075 | 130 | 0.02 |
| Example 2 | 2 | 1 | −0.285 | 1.8 | 9 | 0.135 | 145 | 0.01 |
| Example 3 | 3 | 1 | −0.285 | 2.6 | 13 | 0.195 | 153 | 0.005 |
| Example 4 | 4 | 1 | −0.285 | 0.6 | 3 | 0.045 | 127 | 0.05 |
| Example 5 | 5 | 1 | −0.285 | 3 | 15 | 0.225 | 176 | 0.005 |
| Example 6 | 6 | 3 | −0.275 | 2.4 | 12 | 0.06 | 118 | 0.018 |
| Example 7 | 7 | 3 | −0.275 | 4 | 20 | 0.1 | 125 | 0.014 |
| Example 8 | 8 | 3 | −0.275 | 6 | 30 | 0.15 | 134 | 0.013 |
| Example 9 | 9 | 3 | −0.275 | 2 | 10 | 0.05 | 114 | 0.026 |
| Example 10 | 10 | 3 | −0.275 | 10 | 50 | 0.25 | 172 | 0.009 |
| Example 11 | 11 | 5 | −0.377 | 0.2 | 1 | 0.107 | 146 | 0.017 |
| Example 12 | 12 | 5 | −0.377 | 0.6 | 3 | 0.321 | 260 | 0.003 |
| Example 13 | 13 | 9 | −0.282 | 1.2 | 6 | 0.072 | 140 | 0.01 |
| Example 14 | 14 | 9 | −0.282 | 2 | 10 | 0.12 | 157 | 0.006 |
| Example 15 | 15 | 9 | −0.282 | 3 | 15 | 0.18 | 164 | 0.003 |
| Example 16 | 16 | 9 | −0.282 | 0.6 | 3 | 0.036 | 134 | 0.024 |
| Example 17 | 17 | 9 | −0.282 | 4 | 20 | 0.24 | 209 | 0.001 |

P No.: Photoreceptor No.

C No.: Compound No. in Table 1

EP: Electric potential

ACW: Parts by Weight of Amine Compound

ACC: Content of Amine Compound

F(I): Formula (I)

DID: Difference of Image Density

Comparative Examples 1 to 3

The procedure for preparation of the electrophotographic photoreceptor in Example 1 was repeated to prepare electrophotographic photoreceptors 18 to 20 except for replacing the compound having an amine site in the CTL coating liquid with a compound having an amine site and the following formula (10):

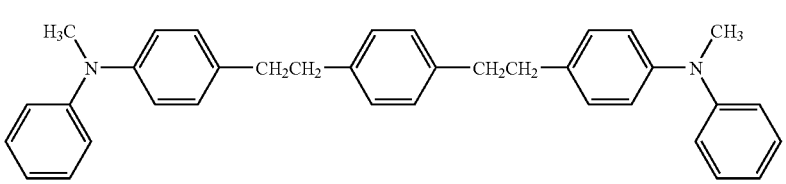

(10)

Comparative Example 4

The procedure for preparation of the electrophotographic photoreceptor in Example 1 was repeated to prepare a electrophotographic photoreceptor 21 except for excluding the compound having an amine site in the CTL coating liquid

TABLE 3

| | P No. | C No. | EP | ACW | ACC | F(I) | VL(−V) | DID |
|---|---|---|---|---|---|---|---|---|
| Comparative Example 1 | 18 | 10 | −0.214 | 1 | 5 | −0.28 | 110 | 0.11 |
| Comparative Example 2 | 19 | 10 | −0.214 | 2 | 10 | −0.56 | 112 | 0.14 |
| Comparative Example 3 | 20 | 10 | −0.214 | 6 | 30 | −1.68 | 114 | 0.15 |
| Comparative Example 4 | 21 | — | — | — | — | — | 108 | 0.18 |

Examples 18 to 34 and Comparative Examples 5 to 8

Each of the procedures of preparation of electrophotographic photoreceptors in Examples 1 to 17 and Comparative Examples 5 to 8 was repeated to prepare electrophotographic photoreceptors 22 to 42 except for replacing the CGL coating liquid with a CGL coating liquid having the following formulation.

| CGL coating liquid | |
|---|---|
| Oxotitaniumphthalocyanine | 8 |
| having the powder XD spectrum in Fig. | 11 |
| Polyvinylbutyral | 5 |
| 2-butanone | 400 |

TABLE 4

| | P No. | C No. | EP | ACW | ACC | F(I) | VL(−V) | DID |
|---|---|---|---|---|---|---|---|---|
| Example 18 | 22 | 1 | −0.285 | 1 | 5 | 0.075 | 134 | 0.019 |
| Example 19 | 23 | 1 | −0.285 | 1.8 | 9 | 0.135 | 146 | 0.01 |
| Example 20 | 24 | 1 | −0.285 | 2.6 | 13 | 0.195 | 158 | 0.005 |
| Example 21 | 25 | 1 | −0.285 | 0.6 | 3 | 0.045 | 136 | 0.046 |
| Example 22 | 26 | 1 | −0.285 | 3 | 15 | 0.225 | 180 | 0.005 |
| Example 23 | 27 | 3 | −0.275 | 2.4 | 12 | 0.06 | 128 | 0.016 |
| Example 24 | 28 | 3 | −0.275 | 4 | 20 | 0.1 | 125 | 0.013 |
| Example 25 | 29 | 3 | −0.275 | 6 | 30 | 0.15 | 138 | 0.013 |
| Example 26 | 30 | 3 | −0.275 | 2 | 10 | 0.05 | 118 | 0.025 |
| Example 27 | 31 | 3 | −0.275 | 10 | 50 | 0.25 | 177 | 0.009 |
| Example 28 | 32 | 5 | −0.377 | 0.2 | 1 | 0.107 | 150 | 0.016 |
| Example 29 | 33 | 5 | −0.377 | 0.6 | 3 | 0.321 | 269 | 0.003 |
| Example 30 | 34 | 9 | −0.282 | 1.2 | 6 | 0.072 | 150 | 0.01 |
| Example 31 | 35 | 9 | −0.282 | 2 | 10 | 0.12 | 159 | 0.006 |
| Example 32 | 36 | 9 | −0.282 | 3 | 15 | 0.18 | 166 | 0.003 |
| Example 33 | 37 | 9 | −0.282 | 0.6 | 3 | 0.036 | 143 | 0.024 |
| Example 34 | 38 | 9 | −0.282 | 4 | 20 | 0.24 | 213 | 0.001 |
| Comparative Example 5 | 39 | 10 | −0.214 | 1 | 5 | −0.28 | 117 | 0.103 |
| Comparative Example 6 | 40 | 10 | −0.214 | 2 | 10 | −0.56 | 121 | 0.117 |
| Comparative Example 7 | 41 | 10 | −0.214 | 6 | 30 | −1.68 | 119 | 0.147 |
| Comparative Example 8 | 42 | — | — | — | — | — | 111 | 0.18 |

Examples 35 to 51 and Comparative Examples 9 to 12

Each of the procedures of preparation of electrophotographic photoreceptors in Examples 18 to 34 and Comparative Examples 5 to 8 was repeated to prepare electrophotographic photoreceptors 43 to 63 except for replacing the CTL coating liquid with a CTL coating liquid having the following formulation.

| CTL coating liquid |
|---|
| C-type polycarbonate |
| The compound having an amine site in Table 1 |
| (No. and parts by weight are shown in Table 5) |
| CTM having the following formula: |
| (8 parts by weight minus parts by weight of the compound having an amine site) |

-continued

| CTL coating liquid |
|---|
| 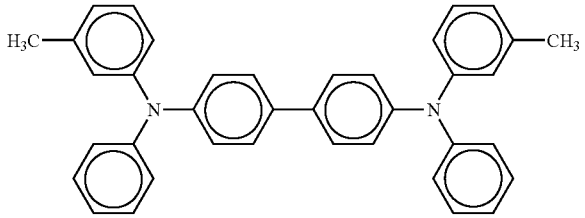 |

TABLE 5

| | P No. | C No. | EP | ACW | ACC | F(I) | VL(−V) | DID |
|---|---|---|---|---|---|---|---|---|
| Example 35 | 43 | 1 | −0.285 | 0.9 | 5 | 0.075 | 108 | 0.019 |
| Example 36 | 44 | 1 | −0.285 | 1.62 | 9 | 0.135 | 120 | 0.01 |
| Example 37 | 45 | 1 | −0.285 | 2.34 | 13 | 0.195 | 144 | 0.005 |
| Example 38 | 46 | 1 | −0.285 | 0.54 | 3 | 0.045 | 102 | 0.046 |
| Example 39 | 47 | 1 | −0.285 | 2.7 | 15 | 0.225 | 174 | 0.005 |
| Example 40 | 48 | 3 | −0.275 | 2.16 | 12 | 0.06 | 93 | 0.017 |
| Example 41 | 49 | 3 | −0.275 | 3.6 | 20 | 0.1 | 109 | 0.014 |
| Example 42 | 50 | 3 | −0.275 | 5.4 | 30 | 0.15 | 108 | 0.013 |
| Example 43 | 51 | 3 | −0.275 | 1.8 | 10 | 0.05 | 87 | 0.026 |
| Example 44 | 52 | 3 | −0.275 | 9 | 50 | 0.25 | 171 | 0.008 |
| Example 45 | 53 | 5 | −0.377 | 0.18 | 1 | 0.107 | 144 | 0.016 |
| Example 46 | 54 | 5 | −0.377 | 0.54 | 3 | 0.321 | 251 | 0.003 |
| Example 47 | 55 | 9 | −0.282 | 1.08 | 6 | 0.072 | 121 | 0.009 |
| Example 48 | 56 | 9 | −0.282 | 1.8 | 10 | 0.12 | 156 | 0.006 |
| Example 49 | 57 | 9 | −0.282 | 2.7 | 15 | 0.18 | 153 | 0.003 |
| Example 50 | 58 | 9 | −0.282 | 0.54 | 3 | 0.036 | 133 | 0.022 |
| Example 51 | 59 | 9 | −0.282 | 3.6 | 20 | 0.24 | 201 | 0.001 |
| Comparative Example 9 | 60 | 10 | −0.214 | 0.9 | 5 | −0.28 | 86 | 0.106 |
| Comparative Example 10 | 61 | 10 | −0.214 | 1.8 | 10 | −0.56 | 86 | 0.127 |
| Comparative Example 11 | 62 | 10 | −0.214 | 5.4 | 30 | −1.68 | 110 | 0.141 |
| Comparative Example 12 | 63 | — | — | — | — | — | 101 | 0.177 |

Examples 52 to 68 and Comparative Examples 13 to 16

Each of the procedures of preparation of electrophotographic photoreceptors in Examples 35 to 51 and Comparative Examples 9 to 12 was repeated to prepare electrophotographic photoreceptors 64 to 84 except for replacing the CTM in the CTL coating liquid with a CTM having the following formula.

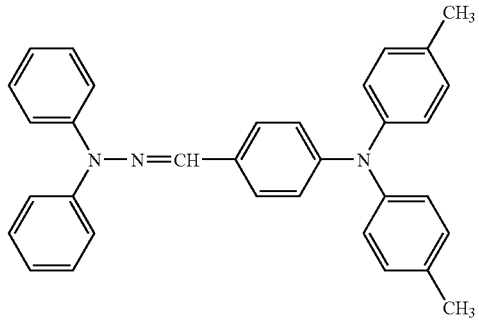

TABLE 6

| | P No. | C No. | EP | ACW | ACC | F(I) | VL(−V) | DID |
|---|---|---|---|---|---|---|---|---|
| Example 52 | 64 | 1 | −0.285 | 0.9 | 5 | 0.075 | 115 | 0.017 |
| Example 53 | 65 | 1 | −0.285 | 1.62 | 9 | 0.135 | 144 | 0.009 |
| Example 54 | 66 | 1 | −0.285 | 2.34 | 13 | 0.195 | 143 | 0.005 |
| Example 55 | 67 | 1 | −0.285 | 0.54 | 3 | 0.045 | 102 | 0.047 |
| Example 56 | 68 | 1 | −0.285 | 2.7 | 15 | 0.225 | 169 | 0.005 |
| Example 57 | 69 | 3 | −0.275 | 2.16 | 12 | 0.06 | 104 | 0.015 |
| Example 58 | 70 | 3 | −0.275 | 3.6 | 20 | 0.1 | 103 | 0.012 |
| Example 59 | 71 | 3 | −0.275 | 5.4 | 30 | 0.15 | 130 | 0.012 |
| Example 60 | 72 | 3 | −0.275 | 1.8 | 10 | 0.05 | 90 | 0.024 |
| Example 61 | 73 | 3 | −0.275 | 9 | 50 | 0.25 | 169 | 0.008 |
| Example 62 | 74 | 5 | −0.377 | 0.18 | 1 | 0.107 | 124 | 0.014 |
| Example 63 | 75 | 5 | −0.377 | 0.54 | 3 | 0.321 | 237 | 0.003 |
| Example 64 | 76 | 9 | −0.282 | 1.08 | 6 | 0.072 | 116 | 0.009 |
| Example 65 | 77 | 9 | −0.282 | 1.8 | 10 | 0.12 | 153 | 0.005 |
| Example 66 | 78 | 9 | −0.282 | 2.7 | 15 | 0.18 | 151 | 0.003 |
| Example 67 | 79 | 9 | −0.282 | 0.54 | 3 | 0.036 | 127 | 0.021 |
| Example 68 | 80 | 9 | −0.282 | 3.6 | 20 | 0.24 | 196 | 0.001 |
| Comparative Example 13 | 81 | 10 | −0.214 | 0.9 | 5 | −0.28 | 100 | 0.098 |
| Comparative Example 14 | 82 | 10 | −0.214 | 1.8 | 10 | −0.56 | 90 | 0.126 |
| Comparative Example 15 | 83 | 10 | −0.214 | 5.4 | 30 | −1.68 | 106 | 0.135 |
| Comparative Example 16 | 84 | — | — | — | — | — | 108 | 0.167 |

Examples 69 to 85 and Comparative Examples 17 to 20

An undercoat coating liquid, a charge generation coating liquid and charge transport coating liquid, which have the following formulations, were coated in this order on an aluminum cylinder by a dip coating method and dried to form an undercoat layer of 3.5 μm thick, a CGL of 0.2 μm thick, a CTL of 23 μm thick thereon.

| Undercoat layer coating liquid | |
|---|---|
| Titanium dioxide powder | 400 |
| Melamine resin | 65 |
| Alkyd resin | 120 |
| 2-butanone | 400 |

| CGL coating liquid | |
|---|---|
| Fluorenone bisazo pigment having the following formula | 12 |

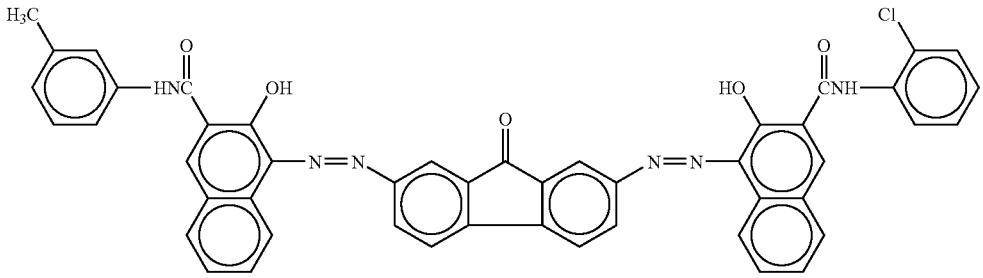

| | |
|---|---|
| Polyvinyl butyral | 5 |
| 2-butanone | 200 |
| Cyclohexanone | 400 |

| CTL coating liquid | |
|---|---|
| Polycarbonate resin (Z polyca from Teijin Chemicals Ltd.) | 10 |
| CTM having the following formula: | 10 |
| 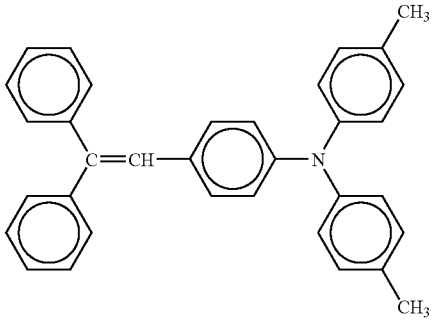 | |
| Tetrahydrofuran | 100 |

Further, a protection layer having a thickness of about 5 μm is formed on the CTL by spraying a protection layer coating liquid having the following formulation onto the CTL to prepare electrophotographic photoreceptors 85 to 105.

| Protection layer coating liquid | |
|---|---|
| Alumina having an average primary particle diameter of 0.3 μm SUMICO RUNDUM AA-03 from Sumitomo Chemical Co., Ltd. | 1 |
| Unsaturated polycarbonate polymer solution having an acid value of 180 mg KOH/g BYK-P 104 from BYK Chemie GmbH | 0.0125 |
| The compound having an amine site in Table 1 (No. and parts by weight are shown in Table 7) | |
| CTM having the following formula: | |
| (3.5 parts by weight minus parts by weight of the compound having an amine site) | |

-continued

| Protection layer coating liquid | |
|---|---|
| 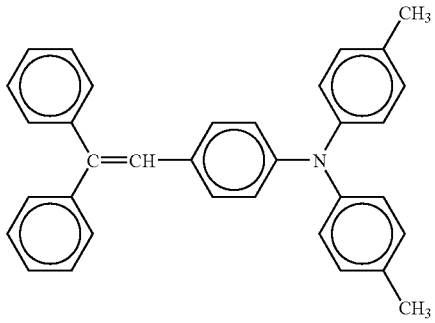 | |
| Polycarbonate resin (Z polyca from Teijin Chemicals Ltd.) | 5 |
| Tetrahydrofuran | 250 |
| Cyclohexanone | 70 |

TABLE 7

| | P No. | C No. | EP | ACW | ACC | F(I) | VL(−V) | DID |
|---|---|---|---|---|---|---|---|---|
| Example 69 | 85 | 1 | −0.285 | 0.48 | 5 | 0.075 | 117 | 0.02 |
| Example 70 | 86 | 1 | −0.285 | 0.86 | 9 | 0.135 | 130 | 0.009 |
| Example 71 | 87 | 1 | −0.285 | 1.24 | 13 | 0.195 | 139 | 0.005 |
| Example 72 | 88 | 1 | −0.285 | 0.29 | 3 | 0.045 | 115 | 0.046 |
| Example 73 | 89 | 1 | −0.285 | 1.43 | 15 | 0.225 | 175 | 0.005 |
| Example 74 | 90 | 3 | −0.275 | 1.14 | 12 | 0.06 | 101 | 0.016 |
| Example 75 | 91 | 3 | −0.275 | 1.90 | 20 | 0.1 | 102 | 0.014 |
| Example 76 | 92 | 3 | −0.275 | 2.85 | 30 | 0.15 | 120 | 0.012 |
| Example 77 | 92 | 3 | −0.275 | 0.95 | 10 | 0.05 | 104 | 0.024 |
| Example 78 | 94 | 3 | −0.275 | 4.76 | 50 | 0.25 | 210 | 0.009 |
| Example 79 | 95 | 5 | −0.377 | 0.10 | 1 | 0.107 | 123 | 0.017 |
| Example 80 | 96 | 5 | −0.377 | 0.29 | 3 | 0.321 | 259 | 0.003 |
| Example 81 | 97 | 9 | −0.282 | 0.57 | 6 | 0.072 | 138 | 0.009 |
| Example 82 | 98 | 9 | −0.282 | 0.95 | 10 | 0.12 | 152 | 0.006 |
| Example 83 | 99 | 9 | −0.282 | 1.43 | 15 | 0.18 | 151 | 0.003 |
| Example 84 | 100 | 9 | −0.282 | 0.29 | 3 | 0.036 | 108 | 0.022 |
| Example 85 | 101 | 9 | −0.282 | 1.90 | 20 | 0.24 | 204 | 0.001 |
| Comparative Example 17 | 102 | 10 | −0.214 | 0.48 | 5 | −0.28 | 109 | 0.107 |
| Comparative Example 18 | 103 | 10 | −0.214 | 0.95 | 10 | −0.56 | 74 | 0.126 |
| Comparative Example 19 | 104 | 10 | −0.214 | 2.85 | 30 | −1.68 | 93 | 0.135 |
| Comparative Example 20 | 105 | — | — | — | — | — | 80 | 0.167 |

Example 86

The procedure for preparation of electrophotographic photoreceptor 97 in Example 81 was repeated to prepare an electrophotographic photoreceptor 106 except for replacing the unsaturated polycarbonate polymer solution in the protection layer coating liquid with the following material:

| | |
|---|---|
| Unsaturated polycarbonate polymer solution having an acid value of 650 mg KOH/g from Fujisawa Pharmaceutical Co., Ltd. | 0.02 |

Example 87

The procedure for preparation of electrophotographic photoreceptor 97 in Example 81 was repeated to prepare an electrophotographic photoreceptor 107 except for replacing the unsaturated polycarbonate polymer solution in the protection layer coating liquid with the following material:

| | |
|---|---|
| Acrylic acid/hydroxyethylmethacrylate having an acid value of 50 mg KOH/g | 0.1 |

Example 88

The procedure for preparation of electrophotographic photoreceptor 97 in Example 81 was repeated to prepare an electrophotographic photoreceptor 108 except for replacing the unsaturated polycarbonate polymer solution in the protection layer coating liquid with the following material:

| | |
|---|---|
| Polyester resin having an acid value of 7 mg KOH/g | 0.2 |

Example 89

The procedure for preparation of electrophotographic photoreceptor 97 in Example 81 was repeated to prepare an electrophotographic photoreceptor 109 except for adding the following material in the protection layer coating liquid:

| | |
|---|---|
| Hindered phenol compound having the following formula: 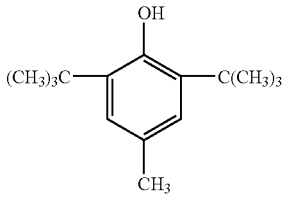 | 0.12 |

TABLE 8

| | P No. | C No. | EP | ACW | ACC | F(I) | VL(−V) | DID |
|---|---|---|---|---|---|---|---|---|
| Example 86 | 106 | 9 | −0.282 | 0.57 | 6 | 0.072 | 120 | 0.015 |
| Example 87 | 107 | 9 | −0.282 | 0.58 | 6 | 0.072 | 142 | 0.004 |
| Example 88 | 108 | 9 | −0.282 | 0.58 | 6 | 0.072 | 180 | 0.003 |
| Example 89 | 109 | 9 | −0.282 | 0.58 | 6 | 0.072 | 138 | 0.009 |

The invention claimed is:

1. An electrophotographic photoreceptor, comprising:

an electroconductive substrate; and a photosensitive layer, located overlying the electroconductive substrate, wherein an outermost layer of the electrophotographic photoreceptor includes an amine compound and a charge transport material, wherein the amine compound includes an amine site having an electrostatic potential with a dimensionless unit not greater than −0.27, wherein the following relationship is satisfied:

$$0.06 \leqq -(V-(-0.27))X \leqq 0.2,$$

wherein V is the electrostatic potential, having a dimensionless unit, of the amine site in the amine compound; and X is a content (% by weight) of the amine compound, wherein the outermost layer is a protection layer, and includes a filler, and wherein the amine compound is a compound having the following formula:

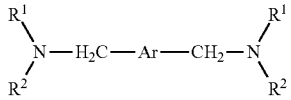

wherein $R^1$ and $R^2$ independently represent substituted or unsubstituted alkyl group, or a substituted or unsubstituted aromatic hydrocarbon group, and one of $R^1$ and $R^2$ is a substituted or unsubstituted aromatic hydrocarbon group, and may be combined with each other to form a heterocyclic group including a nitrogen atom; and Ar represents a substituted or unsubstituted aromatic hydrocarbon group.

2. The electrophotographic photoreceptor of claim 1, wherein the filler is a metal oxide.

3. The electrophotographic photoreceptor of claim 1, wherein the filler has an average primary particle diameter of 0.01 to 1.0 μm.

4. The electrophotographic photoreceptor of claim 1, wherein the protection layer includes the filler in an amount of 0.1 to 50% by weight.

5. The electrophotographic photoreceptor of claim 1, wherein the protection layer includes an organic compound having an acid value of 10 to 700 mg KOH/g.

6. The electrophotographic photoreceptor of claim 5, wherein the organic compound is a polycarboxylic acid.

7. The electrophotographic photoreceptor of claim 6, wherein the polycarboxylic acid is a polyester resin, an acrylic resin, a copolymer including structures of the polyester resin and acrylic resin, or a mixture thereof

8. The electrophotographic photoreceptor of claim 6, wherein the polycarboxylic acid includes at least one organic fatty acid.

9. The electrophotographic photoreceptor of claim 1, wherein the outermost layer includes an antioxidant.

10. The electrophotographic photoreceptor of claim 9, wherein the antioxidant is a hindered phenol compound.

11. An image forming apparatus, comprising:

at least one image forming components each including:

electrophotographic photoreceptor according to claim 1, a charger configured to charge the electrophotographic photoreceptor, an irradiator configured to irradiate the electrophotographic photoreceptor to form an electrostatic latent image on the electrophotographic photoreceptor, an image developer configured to develop the electrostatic latent image with a toner to form a toner image on the electrophotographic photoreceptor, a transferer configured to transfer the toner image onto a recording medium, and a fixer configured to fix the toner image on the recording medium.

12. The image forming apparatus of claim 11, further comprising:

a cleaner configured to remove the toner remaining on a surface of the electrophotographic photoreceptor while contacting the electrophotographic photoreceptor.

13. The image forming apparatus of claim 11, wherein the irradiator includes a laser diode or a light emitting diode.

14. The image forming apparatus of claim 11, wherein the image forming apparatus is configured to overlap a plurality of toner images having different colors on top of each other to form a full-color image.

15. The image forming apparatus of claim 11, wherein the image forming apparatus is a tandem image forming apparatus, and the at least one image forming components includes at least two image forming components.

16. The image forming apparatus of claim 11, further comprising:

an intermediate transferer configured to receive the toner image from the electrophotographic photoreceptor; and a second transferer configured to transfer the toner image on the intermediate transferer onto the recording medium, wherein a plurality of toner images having different colors are overlapped on the intermediate transferer to form a full-color image and the full-color image is transferred onto the recording medium.

17. An image forming method, comprising:

charging the electrophotographic photoreceptor according to claim 1;

irradiating the electrophotographic photoreceptor to form an electrostatic latent image the electrophotographic photoreceptor;

developing the electrostatic latent image with a toner to form a toner image on the electrophotographic photoreceptor;

transferring the toner image onto a recording medium; and fixing the toner image on the recording medium.

18. A process cartridge, comprising:

the electrophotographic photoreceptor according to claim 1; and at least one of a charger, an irradiator, an image developer, a transferer and a cleaner.

19. An electrophotographic photoreceptor, comprising:

an electroconductive substrate; and a photosensitive layer, located overlying the electroconductive substrate, wherein an outermost layer of the electrophotographic photoreceptor includes an amine compound and a charge transport material, wherein the amine compound includes an amine site having an electrostatic potential with a dimensionless unit not greater than −0.27, wherein the following relationship is satisfied:

$$0.06 \leqq -(V-(-0.27))X \leqq 0.2,$$

wherein V is the electrostatic potential, having a dimensionless unit, of the amine site in the amine compound; and X is a content (% by weight) of the amine compound, wherein the outermost layer is a protection layer, and includes a filler, and wherein the charge transport material is a compound having the following formula:

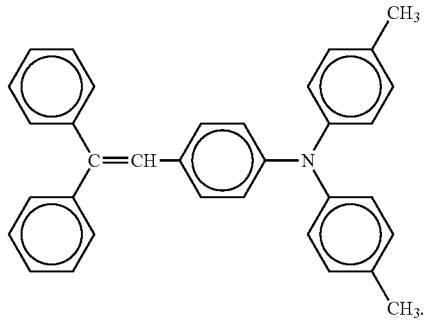

* * * * *